US012760912B2

(12) United States Patent
Jeddy et al.

(10) Patent No.: US 12,760,912 B2
(45) Date of Patent: Oct. 13, 2026

(54) INTEGRATED HVAC SYSTEM WITH VARIABLE REFRIGERANT FLOW UNIT AND AIR HANDLING UNIT

(71) Applicant: Johnson Controls Tyco IP Holdings LLP, Milwaukee, WI (US)

(72) Inventors: Taufiq Ahmed Jeddy, Frisco, TX (US); Mohammed Sami Ahmed, Irving, TX (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 105 days.

(21) Appl. No.: 18/726,695

(22) PCT Filed: Jan. 3, 2023

(86) PCT No.: PCT/US2023/010059

§ 371 (c)(1),
(2) Date: Jul. 3, 2024

(87) PCT Pub. No.: WO2023/130122

PCT Pub. Date: Jul. 6, 2023

(65) Prior Publication Data

US 2025/0085002 A1 Mar. 13, 2025

Related U.S. Application Data

(60) Provisional application No. 63/296,121, filed on Jan. 3, 2022.

(51) Int. Cl.
*F24F 1/022* (2019.01)
*F24F 1/029* (2019.01)
(Continued)

(52) U.S. Cl.
CPC ..... *F24F 1/022* (2013.01); *F24F 1/029* (2019.02); *F24F 1/0326* (2019.02); *F24F 11/88* (2018.01); *F24F 13/20* (2013.01)

(58) Field of Classification Search
CPC ..... F24F 11/86; F24F 11/81; F24F 13/20
See application file for complete search history.

(56) References Cited

U.S. PATENT DOCUMENTS

2016/0298871 A1 10/2016 Gillatt
2022/0136749 A1* 5/2022 Hariharan ..... F25B 41/20 62/80

FOREIGN PATENT DOCUMENTS

CN 1590859 A * 3/2005
CN 104061630 A 9/2014
(Continued)

OTHER PUBLICATIONS

PCT/US2023/010059 International Search Report and Written Opinion mailed May 2, 2023.

*Primary Examiner* — Ana M Vazquez
(74) *Attorney, Agent, or Firm* — Fletcher Yoder, P.C.

(57) ABSTRACT

A heating, ventilation, and air conditioning (HVAC) system includes a variable refrigerant flow (VRF) unit including a variable speed compressor, a VRF heat exchanger, and a reversing valve of a vapor compression circuit. In addition, the HVAC system includes an air handling unit (AHU) including an AHU heat exchanger of the vapor compression circuit. Furthermore, the HVAC system includes a housing, wherein the VRF unit and the AHU are disposed within the housing, and wherein the variable speed compressor is configured to circulate a refrigerant through the VRF heat exchanger and the AHU heat exchanger, and the reversing valve is configured to adjust a flow direction of the refrigerant through the vapor compression circuit to adjust operation of the HVAC system between a cooling operation mode and a heating operation mode.

20 Claims, 12 Drawing Sheets

(51) Int. Cl.

| | |
|---|---|
| ***F24F 1/0326*** | (2019.01) |
| ***F24F 11/88*** | (2018.01) |
| ***F24F 13/20*** | (2006.01) |

(56) References Cited

FOREIGN PATENT DOCUMENTS

| | | | | | |
|---|---|---|---|---|---|
| CN | 212108739 | U | | 12/2020 | |
| JP | 2006336999 | A | * | 12/2006 | |
| KR | 20050118506 | A | | 12/2005 | |
| KR | 20050122624 | A | | 12/2005 | |
| KR | 20210073007 | A | * | 6/2021 | ..... F24F 13/20 |

* cited by examiner

INTEGRATED HVAC SYSTEM WITH VARIABLE REFRIGERANT FLOW UNIT AND AIR HANDLING UNIT

CROSS-REFERENCE TO RELATED APPLICATIONS

This application is a U.S. National Stage Application of PCT International Application No. PCT/US2023/010059, entitled "INTEGRATED HVAC SYSTEM WITH VARIABLE REFRIGERANT FLOW UNIT AND AIR HANDLING UNIT," filed Jan. 3, 2023, which claims priority to and the benefit of U.S. Provisional Application No. 63/296,121, entitled "HVAC SYSTEM," filed Jan. 3, 2022, each of which is hereby incorporated by reference in its entirety for all purposes.

BACKGROUND

This section is intended to introduce the reader to various aspects of art that may be related to the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial applications to control environmental properties, such as temperature and humidity, for occupants of respective environments. An HVAC system may control the environmental properties through control of properties of an air flow delivered to and ventilated from spaces serviced by the HVAC system. For example, the HVAC system may transfer heat between the air flow and a working fluid (e.g., refrigerant) flowing through the system (e.g., a heat exchanger) to provide cooled air for an indoor environment. Similarly, the HVAC system may heat the air flow to provide warmth to the indoor environment. In some situations, the HVAC system may cool the air flow and then heat the air flow to reduce humidity of the air flow while providing air at a desired temperature to the indoor environment. The HVAC system may also control a flow rate of the air flow to manage (e.g., expedite adjustment of) environmental conditions.

Furthermore, many conventional HVAC systems may include separate systems to enable operation in a cooling mode and a heating mode. For example, conventional HVAC systems may include a vapor compression circuit with a condenser and an evaporator to facilitate heat transfer between a cooled refrigerant within the evaporator and an air flow flowing across the evaporator when operating in a cooling mode. The HVAC system may include a separate system, such as a furnace, to facilitate heat transfer between a working fluid, such as a flow of hot gases, and an air flow flowing across a separate heat exchanger. However, such HVAC systems may be costly and/or inefficient.

Additionally, some portions of the HVAC system may be installed external to a building, such as on a roof of the building, to control the environmental properties of a space within the building. However, other equipment of the HVAC system, such as a furnace, may be installed within the building, such as in an equipment room. Some HVAC systems may include a variable refrigerant flow system that includes an outdoor unit positioned external to a building and includes multiple indoor units positioned throughout and within the building. However, such HVAC systems include extensive and/or complex pipping to fluidly connect the outdoor unit to the multiple indoor units.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and air conditioning (HVAC) system includes a variable refrigerant flow (VRF) unit including a variable speed compressor, a first heat exchanger, and a reversing valve of a vapor compression circuit. In addition, the HVAC system includes an air handling unit (AHU) including a second heat exchanger of the vapor compression circuit. Furthermore, the HVAC system includes a housing, wherein the VRF unit and the AHU are disposed within the housing, and wherein the variable speed compressor is configured to circulate a refrigerant through the first heat exchanger and the second heat exchanger, and the reversing valve is configured to adjust a flow direction of the refrigerant through the vapor compression circuit to adjust operation of the HVAC system between a cooling operation mode and a heating operation mode.

In another embodiment, a rooftop unit of a heating, ventilation, and air conditioning (HVAC) system includes a housing defining a variable refrigerant flow (VRF) section and an air handling unit (AHU) section, wherein the housing includes a partition extending therethrough and separating the VRF section and the AHU section. The rooftop unit additionally includes a vapor compression system that includes a VRF unit that includes a variable speed compressor, a first heat exchanger, and a reversing valve disposed within the VRF section; and the vapor compression system includes an AHU that includes a second heat exchanger disposed within the AHU section. The VRF unit and the AHU are pre-packaged within the housing, the reversing valve is configured to adjust a flow direction of the refrigerant through a refrigerant circuit of the vapor compression system to adjust operation of the vapor compression system between a heating mode and a cooling mode, the second heat exchanger is configured to place the refrigerant in a heat exchange relationship with an air flow, and the AHU section is configured to discharge the air flow into a conditioned space.

In another embodiment, a packaged unit of a heating, ventilation, and air conditioning (HVAC) system includes a housing defining a variable refrigerant flow (VRF) section and an air handling unit (AHU) section, wherein the housing includes a partition separating the VRF section and the AHU section. In addition, the packaged unit includes a vapor compression system that includes a refrigerant circuit configured to operate in a cooling mode to cool an air flow and to operate in a heating mode to heat the air flow. The vapor compression system further including a plurality of VRF units disposed within the VRF section, wherein each VRF unit of the plurality of VRF units includes a compressor, a first heat exchanger, and a reversing valve. In addition, the vapor compression system includes an AHU disposed within the AHU section, wherein the AHU includes a section heat exchanger to place a refrigerant of the refrigerant circuit in a heat exchange relationship with the air flow, and the AHU is configured to discharge the air flow directly into a conditioned space.

BRIEF DESCRIPTION OF THE DRAWINGS

Various aspects of the present disclosure may be better understood upon reading the following detailed description and upon reference to the drawings, in which.

DETAILED DESCRIPTION

Figure 1:
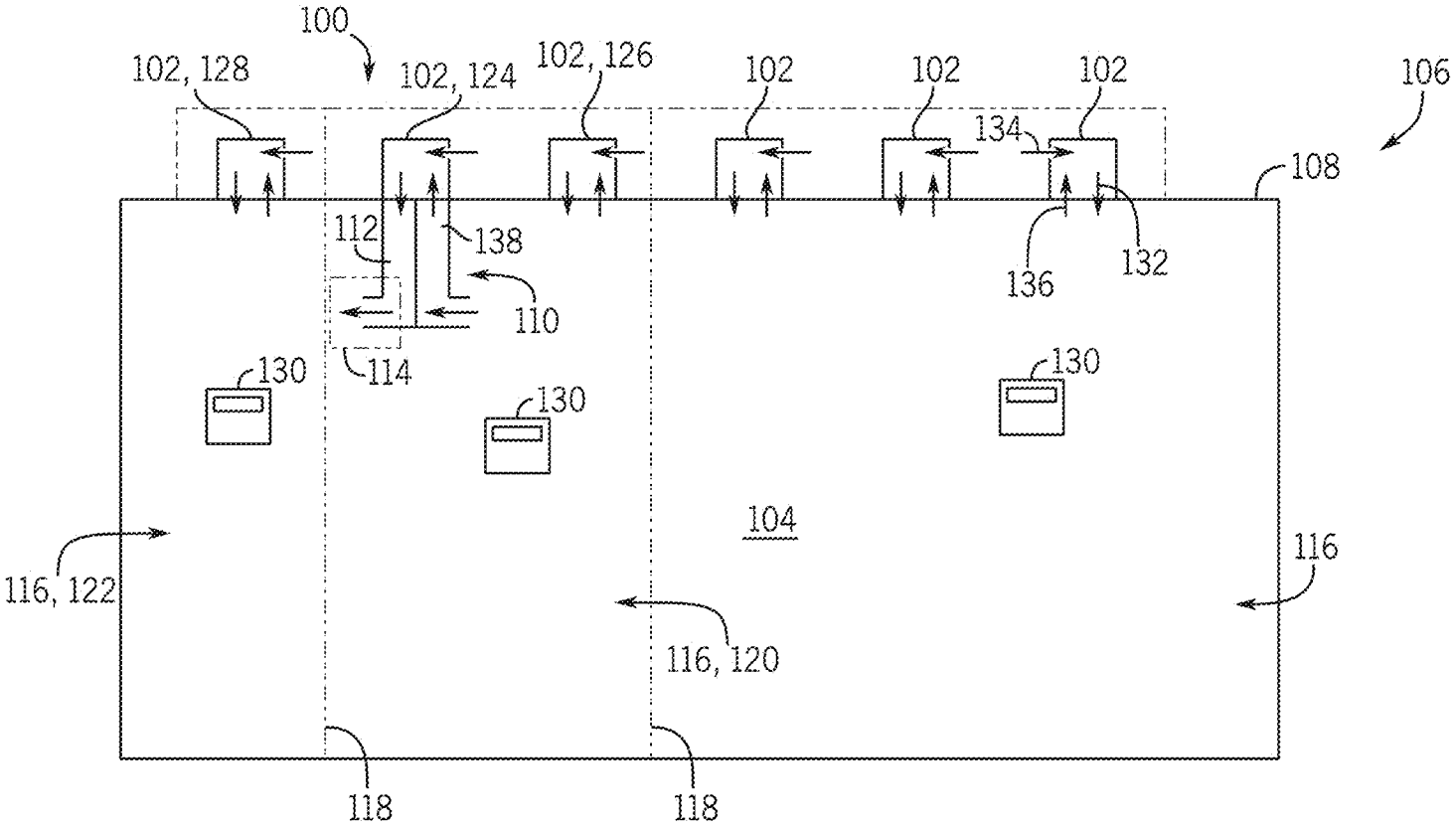
FIG. 1 is a perspective schematic view of an embodiment of a building including a heating, ventilation, and air conditioning (HVAC) system with one or more integrated or packaged HVAC units, each including a variable refrigerant flow (VRF) unit and an air handling unit (AHU) packaged within the HVAC unit, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As briefly discussed above, a heating, ventilation, and/or air conditioning (HVAC) system may be used to thermally regulate a space within a building, home, or other suitable structure. For example, the HVAC system may include a packaged unit, such as a rooftop unit, fluidly coupled to a conditioned space within a building. The packaged unit may include a vapor compression system that transfers thermal energy between a working fluid, such as a refrigerant, and a fluid to be conditioned, such as an air flow directed into the conditioned space. The vapor compression system may include heat exchangers, such as a condenser and an evaporator, which are fluidly coupled to one another via one or more conduits of a refrigerant loop or circuit. The vapor compression system may also include a compressor configured to circulate the refrigerant through the conduits and other components of the refrigerant circuit (e.g., an expansion device, metering device) and, thus, enable the transfer of thermal energy between components of the refrigerant circuit (e.g., between the condenser and the evaporator) and one or more thermal loads (e.g., an environmental air flow, a supply air flow). The vapor compression system may be utilized in a cooling mode of the HVAC system to cool an air flow. However, conventional packaged units or rooftop units may include separate system, such as a furnace, configured to operate in a heating mode to heat the air flow. In accordance with present techniques, a packaged unit includes a vapor compression circuit configured to operate in both a heating mode and cooling mode of the HVAC system. In other words, the packaged unit may operate as a heat pump to heat an air flow and to cool an air flow.

In some instances, the environmental properties of conditioned spaces (e.g., spaces conditioned by the HVAC system) and/or of external air sources (e.g., outside air) may vary, and thus a thermal load (e.g., cooling load, heating load) of the HVAC system may vary depending on an amount of thermal energy to be added to or removed from the conditioned space to satisfy a set temperature of the conditioned space. However, conventional compressors may be ill-suited to dynamically operate to match the varying thermal loads of the HVAC system and, thus, may reduce an overall operational efficiency of the HVAC system.

Accordingly, the present embodiments are directed to an integrated HVAC unit (e.g., a packaged HVAC unit, a single packaged HVAC unit) including a variable refrigerant flow (VRF) unit and an air handling unit (AHU). In other words, the integrated HVAC unit may include the VRF unit and the AHU packaged together in a single unit. As discussed in more detail below, the integrated HVAC unit is configured to provide both cooling and heating of an air flow directed into a conditioned space. The integrated HVAC unit may utilize a single refrigerant circuit (e.g., or a set of fluidly coupled refrigerant circuits) configured to circulate the same working fluid (e.g., refrigerant) in both cooling and heating modes of the HVAC system. For example, the integrated HVAC unit may control a flow direction of the working fluid through the single refrigerant circuit to transition between the heating and cooling mode. In this way, the integrated HVAC unit may operate as a heat pump and may improve the overall operational efficiency of the HVAC system by reducing an amount of refrigerant and/or piping materials, as compared to an amount of refrigerant and/or piping materials used in conventional HVAC systems, such as conventional VRF systems that include multiple indoor units positioned throughout a building and configured to receive refrigerant from an outdoor unit. The present embodiments further provide for improved synchronization and dynamic control of refrigerant flow rate, compressor speeds, heating and/or cooling modes, and rates of air flow to enable more efficient operation and satisfaction of the varying thermal loads of the HVAC system. Moreover, the present embodiments provide an integrated HVAC unit, such as a rooftop unit, having the VRF unit and the AHU with a centralized control system and centralized power supply to enable more time and cost efficient installation processes.

Turning now to the drawings, FIG. 1 illustrates a schematic view of a building 106 that utilizes a heating, ventilating, and air conditioning (HVAC) system 100 for building environmental management. The HVAC system 100 includes one or more integrated HVAC units 102 (e.g., packaged HVAC unit) having a variable refrigerant flow (VRF) unit and an air handling unit (AHU) integrated with one another and/or packaged together as a single packaged unit. As used herein, an "integrated HVAC unit" and/or a "packaged HVAC unit" refers to an HVAC unit having a VRF unit and an AHU packaged together in a single or common housing. Thus, the integrated or packaged HVAC unit 102 with the VRF unit and AHU may be transported and installed as a single structure, which may facilitate simplified and cost-efficient transportation and installation of the HVAC system 100.

The integrated HVAC units 102 are fluidly coupled to a conditioned space 104 within the building 106. In particular, the conditioned space 104 of the building 106 is thermally regulated by the one or more integrated HVAC units 102 that are configured to be installed on a roof 108 of the building 106. The building 106 may be a commercial structure, a residential structure, industrial structure, or other suitable construction having a space to be conditioned. While the one or more integrated HVAC units 102 are installed on the roof 108 of the building 106 in the illustrated embodiment, in some embodiments the one or more integrated HVAC units 102 may be located and/or installed in other locations, such as equipment rooms and/or areas adjacent the building 106. As further discussed below, each integrated HVAC unit 102 may be a single package unit containing other equipment, such as a blower (e.g., fan), integrated air handler, filters, dampers, a controller, and/or a power supply configured to enable operation of the HVAC system 100.

Furthermore, each integrated HVAC unit 102 may be an air cooling and heating system that implements a refrigeration cycle (e.g., vapor compression cycle) to provide conditioned (e.g., heated and/or cooled) air to the building 106. Specifically, each integrated HVAC unit 102 may include one or more heat exchangers (e.g., evaporators, condensers, microchannel heat exchanger, tube and fin heat exchanger) across which an air flow is passed to condition the air flow before the air flow is supplied to the building 106. In the illustrated embodiment, the integrated HVAC units 102 are rooftop units (RTUs) that condition a supply air stream 132, such as environmental air 134 and/or a return air flow 136 from the building 106. Other outdoor units or conditioning components are also possible. After the integrated HVAC unit 102 conditions the air flow, the air flow is supplied to the conditioned space 104 of the building 106. In some embodiments, the air flow may be supplied to the conditioned space 104 (and/or returned to the integrated HVAC unit 102 from the conditioned space 104) via ductwork 110 extending from the integrated HVAC unit 102 to the conditioned space 104. For example, the ductwork 110 may include one or more supply ducts or conduits 112 to deliver the air flow from the integrated HVAC unit 102 to the conditioned space 104 and/or one or more return ducts or conduits 138 to direct return air from the conditioned space 104 to the integrated HVAC unit 102. In some embodiments, the ductwork 110 may extend to various individual floors or other sections, such as rooms, or conditioning zones of the building 106. In some embodiments, the HVAC system 100 may include terminal units 114 disposed at an end of the supply ducts 112 that may be associated with the floors, rooms, or other sections of the building 106. The terminal units 114 may be configured to distribute the supply air flow to the floors, rooms, or other sections of the building 106. In some embodiments, the terminal units 114 may include air conditioning features in addition to, or instead of, the air conditioning features of the integrated HVAC unit 102. Additionally or alternatively, in some embodiments, the air flow may be supplied directly to the conditioned space 104 from a respective integrated HVAC unit 102. For example, the air flow may exit the integrated HVAC unit 102 and enter the conditioned space 104 of the building 106, such as via an outlet (e.g., opening, discharge port) of the integrated HVAC unit 102 fluidly coupled to the conditioned space 104.

In some embodiments, the conditioned space 104 of the building 106 may be a single fluidly continuous space. In other words, a plurality of integrated HVAC units 102 may supply air to the same, continuous conditioned space 104. In certain embodiments, as illustrated in FIG. 1, the conditioned space 104 may include a plurality of conditioning zones or regions 116. For example, the conditioning zones or regions 116 may be distinct areas or portions of the conditioned space 104 but may nevertheless be fluidly continuous and/or generally undivided. In other embodiments, each conditioning zone 116 of the plurality of conditioning zones 116 may be separated via one or more partitions 118 (e.g., walls, barriers) that may be impermeable to air within the conditioned space 104, such that, for example, air within a first conditioning zone 120 does not mix with air within a second conditioning zone 122. In some embodiments, the one or more partitions 118 may be semi-permeable to the air within the conditioned space 104, such that, for example, air within the first conditioning zone 120 may enter and mix with air in the second conditioning zone 122.

Moreover, each conditioning zone 116 of the plurality of conditioning zones 116 may be a portion of the conditioned space 104 that is associated with one or more respective integrated HVAC units 102. As illustrated, the first conditioned zone 120 is associated with a first and a second integrated HVAC unit 124, 126 of the one or more integrated HVAC units 102 installed on the roof 108 of the building 106. The second conditioning zone 122 is associated with a third integrated HVAC unit 128. In this way, each integrated HVAC unit 102 (e.g., or set of integrated HVAC units 102) may be configured to thermally regulate (e.g., independently regulate, cooperatively regulate) a respective conditioning zone 116 of the plurality of conditioning zones 116 within the conditioned space 104. While the present embodiment illustrates one, two, or three integrated HVAC units 102 associated with a respective conditioning zone 116, it should be understood that additional numbers of integrated HVAC units 102 may be associated with a respective conditioning zone 116 (e.g., 4, 5, 6, 7, 8, 10, 20). The number of integrated HVAC units 102 used to thermally regulate a respective conditioning zone 116 and/or the conditioned space 104 may be based on one or more properties, such as a size, air volume, thermal cooling load, thermal heating load, or any combination thereof, of the respective conditioning zone 116 and/or the conditioned space 104. Furthermore, while the illustrated embodiment includes three conditioning zones 116, in other embodiments, the conditioned space 104 may be divided into a fewer or greater number of conditioning zones 116 (e.g., 1, 2, 4, 5, 6, 10, 20).

As discussed in more detail below, the integrated HVAC units 102 may include a vapor compression system (e.g., a heat pump) configured to both heat and cool the air flow supplied to the conditioned space 104 (e.g., the plurality of conditioning zones 116) of the building 106 with one refrigerant circuit (e.g., a set of fluidly coupled refrigerant circuits) configured to operate in different modes (e.g., cooling mode, heating mode, simultaneous cooling and heating mode). One or more control devices 130, such as a thermostat, may be used to set a desired temperature of the air within the conditioned space 104 (e.g., air within each conditioning zone 116). While the illustrated embodiment includes one control device 130 for each respective conditioning zone 116, in some embodiments, a single control device 130 may be used to regulate conditioning of two or more conditioning zones 116. Furthermore, the control device 130 also may be used to control a flow rate of the air flow discharged from one or more integrated HVAC units 102, entering into the one or more integrated HVAC units 102 (e.g., an amount of return air from the conditioned space 104 and/or outside air from the surrounding environment), through the ductwork 110, discharged from the terminal units 114, or any combination thereof. For example, the control device 130 may be used to regulate operation of one or more components of the integrated HVAC units 102 and/or terminal units 114. In some embodiments, other devices may be included in the HVAC system 100, such as pressure and/or temperature sensors that detect the temperatures and pressures of the supply air, return air, and so forth. Moreover, the control device 130 may include computer systems that are integrated with or separate from other building control or monitoring systems, and may include systems that are remote from the building 106.

Figure 2:
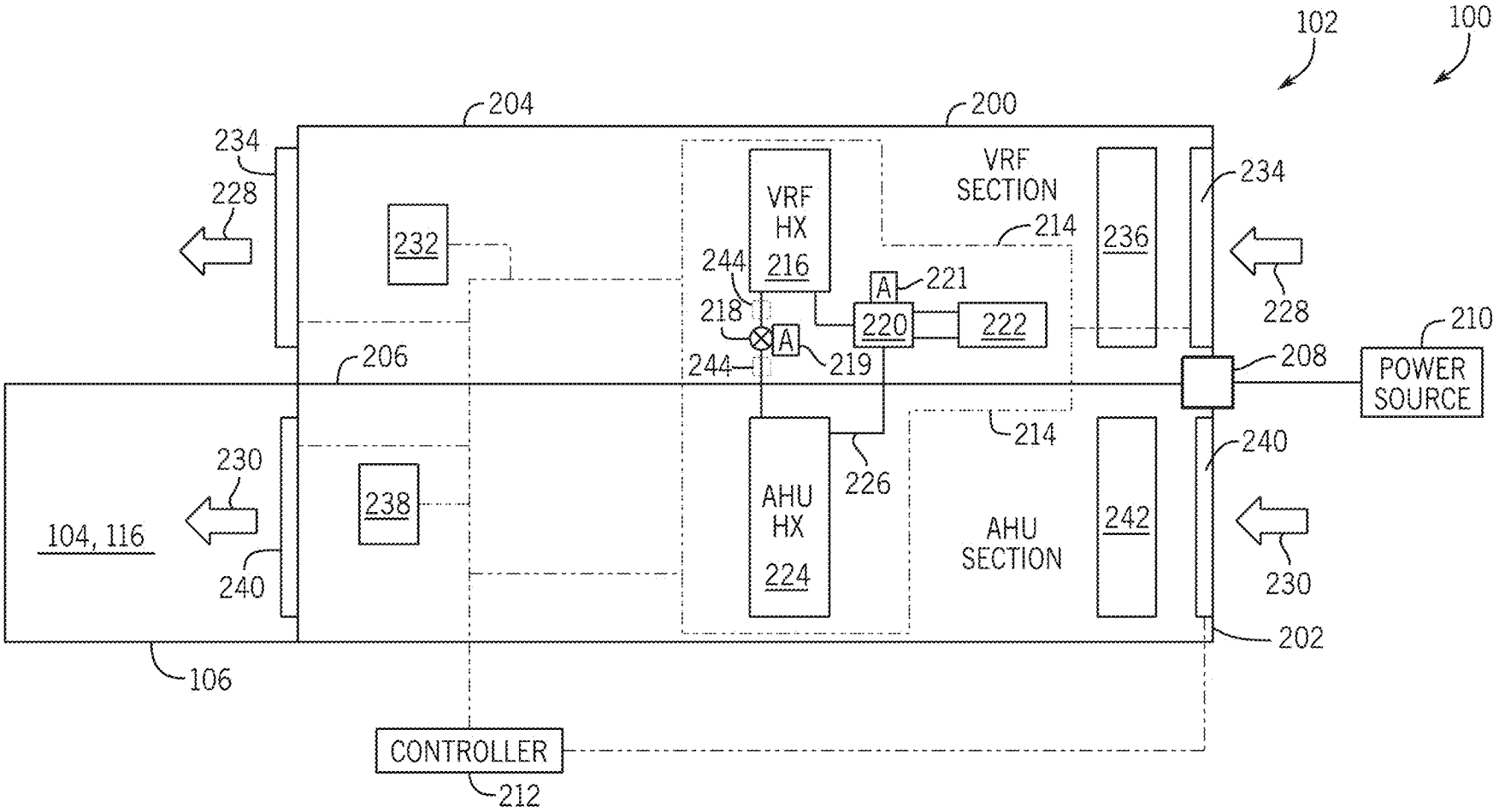
FIG. 2 is a schematic diagram of an embodiment of an integrated HVAC unit having a VRF unit and an AHU, in accordance with an aspect of the present disclosure.

With the foregoing in mind, FIG. 2 is a schematic diagram of an embodiment of the integrated HVAC unit 102 of the HVAC system 100. In the illustrated embodiment, the integrated HVAC units 102 is a single packaged unit that may include one or more refrigeration circuits (e.g., fluidly coupled refrigeration circuits and/or independent refrigeration circuits) and components that are tested, charged, wired, piped, and prepared for installation. The integrated HVAC unit 102 may provide a variety of heating and/or cooling functions, such as cooling only, heating only, simultaneous cooling and heating, cooling with dehumidification, and so forth. As described above, the integrated HVAC unit 102 may directly cool and/or heat an air flow provided to the building 106 to condition the conditioned space 104 (e.g., and/or one or more conditioning zones 116) in the building 106.

In particular, as shown in the illustrated embodiment, the integrated HVAC unit 102 may include a variable refrigerant flow (VRF) section 200 (e.g., VRF compartment), also referred to herein as a VRF unit, and an air handling unit (AHU) section 202 (e.g., AHU compartment), also referred to herein as an AHU. The VRF and AHU sections 200, 202 may each be pre-packaged, pre-pipped, and integrated with one another within a common enclosure 204 (e.g., common housing). In some embodiments, the VRF and AHU sections 200, 202 may be separated by a partition 206 of the enclosure 204. The partition 206 may prevent air contained within the VRF section 200 from mixing with air contained within the AHU section 202. In some embodiments, the partition 206 may include an access door which provides access between the VRF section 200 and the AHU section 202. The VRF and AHU sections 200, 202 may be provided with a single power connection 208 configured to receive electrical power from a power source 210 and to provide power to components of both the VRF and AHU sections 200, 202. In other embodiments, the integrated HVAC unit 102 may include multiple power connections 208. In any case, the packaging of the VRF and AHU sections 200, 202 within the common enclosure 204 having the one or more power connections 208 may enable simplified installation of the integrated HVAC unit 102, such as on the roof 108 of the building 106. In some embodiments, as discussed in more detail below, the integrated HVAC unit 102 may include a centralized controller 212 communicatively coupled to and configured to operate (e.g., via BACnet integration) the components of both the VRF and AHU sections 200, 202.

Moreover, the VRF section 200 and the AHU section 202 may each include one or more components fluidly coupled to each other to construct, establish, or otherwise form a vapor compression system 214 (e.g., vapor compression circuit, refrigerant circuit) of the integrated HVAC unit 102. For example, the one or more components may include one or more heat exchangers 216 (e.g., VRF heat exchangers, VRF unit heat exchangers), one or more expansion devices 218 (e.g., electronic expansion valve, expansion valve, metering device, metering valve), a reversing valve 220, and one or more compressors 222 (e.g., variable speed compressors) disposed within the VRF section 200. The one or more components may also include one or more heat exchangers 224 (e.g., AHU heat exchangers) disposed within the AHU section 202. Furthermore, the one or more components of the vapor compression system 214 may be fluidly coupled (e.g., interconnected) via a refrigerant circuit 226 (e.g., piping, conduits, etc.) configured to direct a flow of refrigerant through the vapor compression system 214. It should be understood, that while the illustrate embodiment illustrates a single refrigerant circuit 226, in some embodiments, the vapor compression system 214 may include any suitable number of refrigerant circuits (e.g., 2, 3, 4, 5, 10) independent of one another, fluidly coupled to one another, or some combination thereof. Continuing with the illustrated embodiment of FIG. 2, a portion of the one or more components of the vapor compression system 214 is disposed within the VRF section 200 and in fluid communication (e.g., via the refrigerant circuit 226) with a portion of the one or more components of the vapor compression system 214 disposed within the AHU section 202. As discussed herein, the one or more components of the vapor compression system 214 may be configured to dynamically adjust a flow of a working fluid, such as a flow of a refrigerant, within the vapor compression system 214 to enable efficient operation of the integrated HVAC unit 102 by enabling the integrated HVAC unit 102 to operate in various operational modes, such as a heating mode, a cooling mode, or both, and/or by enabling transfer of thermal energy via the integrated HVAC unit 102 to more efficiently satisfy a thermal load (e.g., cooling load, heating load) of the conditioned space 104.

As discussed above, the VRF section 200 and the AHU section 202 may each include at least one heat exchanger (e.g., the VRF heat exchanger 216, the AHU heat exchanger 224) configured to place the working fluid (e.g., the refrigerant) in a heat exchange relationship with a respective air flow passing through and/or across the heat exchanger (e.g., the VRF heat exchanger 216, the AHU heat exchanger 224). In particular, tubes (e.g., coils) fluidly coupled to the refrigerant circuit 226 and within each of the VRF and AHU heat exchangers 216, 224 may circulate refrigerant (e.g., glycol, R-1234ze, R-1233zd, ammonia, carbon dioxide, steam, or water) through the VRF and AHU heat exchangers 216, 224. The tubes may be of various types, such as multichannel tubes, copper or aluminum tubing, and so forth. Additionally, the tubes may be in various configurations within the VRF and AHU heat exchangers 216, 224. For example, in some embodiments, each of the VRF and AHU heat exchangers 216, 224 may include a plurality of refrigerant tubes defining a plurality of refrigerant flow paths extending through the VRF and AHU heat exchangers 216, 224 and in parallel with one another. In some embodiments, the plurality of refrigerant tubes may have a plurality of fins extending from the respective refrigerant tubes to increase the surface area, and thus, the heat exchange area of the plurality of refrigerant tubes of the VRF and AHU heat exchangers 216, 224. Together, the VRF and AHU heat exchangers 216, 224 may implement a thermal cycle in which the refrigerant undergoes phase changes and/or temperature changes as it flows through the VRF and AHU heat exchangers 216, 224 to reject or absorb thermal energy and, thus, produce heated and/or cooled air.

As an example, during operation of the vapor compression system 214 in a cooling mode, the compressor 222 may direct refrigerant through the refrigerant circuit 226 and the VRF and AHU heat exchangers 216, 224 in a first flow direction. When receiving the refrigerant directed in the first flow direction (e.g., from the compressor 222 via the reversing value 220), the VRF heat exchanger 216 disposed within the VRF section 200 and in an air flow path of a first air flow 228, may operate as a condenser to reject heat absorbed by the refrigerant. In particular, the VRF heat exchanger 216 may receive a refrigerant flow from the compressor 222 and place the refrigerant flow in a heat exchange relationship with the first air flow 228 (e.g., outdoor air, ambient air) to reject (e.g., expel) heat from the refrigerant to the first air flow 228. The refrigerant flow then exits the VRF heat exchanger 216 and flows through the expansion device 218 (e.g., of the one or more expansion devices 218). The expansion device 218 is configured to expand the refrigerant to reduce a pressure and/or a temperature of the refrigerant and direct the refrigerant to the AHU heat exchanger 224. The AHU heat exchanger 224 disposed in the AHU section 202 and fluidly coupled to the conditioned space 104 may operate as an evaporator and, thus, facilitate refrigerant flowing through the AHU heat exchanger 224 to absorb thermal energy from a second air flow 230 (e.g., outdoor air, return air) flowing across the AHU heat exchanger 224 and into the conditioned space 104. That is, the AHU heat exchanger 224 may receive the refrigerant from the expansion device 218 and place the refrigerant in a heat exchange relationship with the second air flow 230 to absorb thermal energy from the second air flow 230. Furthermore, the refrigerant may exit the AHU heat exchanger 224 and return to the compressor 222 (e.g., via the reversing valve 220). In this way, the vapor compression system 204 may facilitate cooling of the second air flow 230 directed into the conditioned space 104.

Conversely, during operation in a heating mode, the reversing valve 220 (e.g., a switch-over valve) enables the compressor 222 to direct refrigerant through the refrigerant circuit 226 and the VRF and AHU heat exchangers 216, 224 in a second flow direction, opposite the first flow direction. In particular, the reversing value 220 may be configured to switch the flow of refrigerant from the first flow direction to the second flow direction. When receiving the refrigerant in the second flow direction, the AHU heat exchanger 224 may operate as a condenser (e.g., instead of the evaporator in the cooling mode). As such, the AHU heat exchanger 224 may receive a flow of refrigerant from the compressor 222 (e.g., via the reversing value 220) to reject heat to the second air flow 230 flowing across the AHU heat exchanger 224 (e.g., thereby heating the second air flow 230 directed to the conditioned space 104) and, thus, facilitate heating of the conditioned space 104. The VRF heat exchanger 216 may operate as an evaporator (e.g., instead of the condenser in the cooling mode) and facilitate refrigerant flowing through the VRF heat exchanger 216 to absorb thermal energy from the first air flow 228 flowing across the VRF heat exchanger 216. In particular, the VRF heat exchanger 216 may receive the refrigerant from the expansion device 218 (e.g., which receives the refrigerant from the AHU heat exchanger 224) and place the refrigerant in a heat exchange relationship with the first air flow 228 to absorb thermal energy from the first air flow 228. In this way, the vapor compression system 214 may enable both heating or cooling of a thermal load of the conditioned space 104 based on the current operational mode of the vapor compression system 214 (e.g., based on a flow direction of refrigerant along the refrigerant circuit 226). In some embodiments, the refrigerant circuit 226 may include one or more check valves configured to direct a flow of refrigerant through the appropriate one or more expansion devices 218, depending on the flow direction of the refrigerant. Thus, the one or more check valves may facilitate the refrigerant to flow (e.g., pass) through the proper expansion device 218 based on the flow direction of the refrigerant within the refrigerant circuit 226. While the illustrated embodiment shows a single VRF heat exchanger 216, a single AHU heat exchanger 224, a single expansion device 218, and a single reversing valve 220, in some embodiments, the vapor compression system 214 may include any number of VRF and/or AHU heat exchangers, expansion devices, and/or reversing values (e.g., 2, 3, 4, 5, 10) to enable efficient heating and/or cooling of the conditioned space 104.

In some embodiments, the reversing valve 220 may be an electronic reversing valve (ERV) 220 communicatively coupled to the controller 212. The controller 212 may output control signals to the ERV 220 to cause the ERV 220 to adjust a flow path of the refrigerant through the ERV 220 and, thus, reverse a direction of refrigerant flow through the vapor compression system 214 (e.g., the refrigerant circuit 226). Dynamically adjusting the direction of refrigerant flow through the ERV 220 may facilitate operation of the vapor compression system 214 in both a heating mode and a cooling mode. In other words, the vapor compression system 214 may utilize a single reversible refrigerant flow (e.g., a single circuit) for both operation in the cooling mode and in the heating mode. In some embodiments, the ERV 220 may include an ERV actuator 221 communicatively coupled to the controller 212 and configured to adjust a circuit connection within the ERV 220 to change the direction of the refrigerant flow through the refrigerant circuit 226. The ERV actuator 221 may receive the control signals from the controller 212 and may provide feedback signals to controller 212 associated with an operational state of the ERV 220 (e.g., corresponding to the current position of the ERV 220 and/or a current direction of refrigerant flow setting). In particular, the controller 212 may control the operational state of the ERV 220 via a position of the ERV actuator 221 to adjust an operation or mode of the integrated HVAC unit 102 to be in a cooling operational mode or a heating operational mode. As the vapor compression system 214 may utilize a reversible refrigerant circuit disposed within the common housing 204 to enable operation of the integrated HVAC unit 102 in the cooling operational mode and heating operational mode, the present embodiments may use less total refrigerant as compared to conventional HVAC systems, such as conventional VRF systems that utilize an outdoor unit and multiple indoor units distributed throughout a building that are connected to one another via a network of piping. Furthermore, the vapor compression system 214 of the integrated HVAC unit 102 may enable efficient satisfaction of a heating and/or cooling load of the conditioned space/conditioning zone 104, 116, by utilizing a reversible refrigerant circuit with less circulating refrigerant and/or less piping material to construct the refrigerant circuit than a conventional HVAC system.

In some embodiments, the expansion device 218 may be an electronic expansion valve (EEV) 218 communicatively coupled to the controller 212. The controller 212 may output control signals to the EEV 218 to cause the EEV 218 to adjust a rate of refrigerant flow through the EEV 218. Dynamically adjusting the rate of refrigerant flow through the EEV 218 may adjust a temperature and/or pressure of the refrigerant, thus, adjusting a rate of heat exchange between an air flow and a heat exchanger, such as the VRF heat exchanger 216 or AHU heat exchanger 224, depending on the direction of flow of the refrigerant through the vapor compression system 214. In some embodiments, the EEV 218 may include an EEV actuator 219 communicatively coupled to the controller 212 and configured to adjust a size of an opening within the EEV 218 to control an amount (e.g., volume) and/or a rate of refrigerant flow through the opening of the EEV 218. The EEV actuator 219 may receive the control signals from the controller 212 and may provide feedback signals to controller 212 associated with an operational state of the EEV 218 (e.g., corresponding to the size of the opening and/or a current refrigerant flow rate setting). In particular, the controller 212 may control the operational state of the EEV 218 via a position of the EEV actuator 219 to modulate an amount of heating and/or cooling (e.g., via the VRF and AHU heat exchangers 216, 224) of the second air flow 230 (e.g., to achieve a desired setpoint temperature for supply air or to maintain a desired setpoint temperature of supply air within a desired setpoint temperature range) provided to the conditioned space/conditioning zones 116. The operational state of the EEV 218 (e.g., which may affect the amount of heating and/or cooling of the second air flow 230) may correlate with an amount of thermal energy transfer to achieve a desired temperature of the second air flow 230 (e.g., the supply air provided to the conditioned space/conditioning zone 104, 116). In some embodiments, operation of EEV 218 may be adjusted to adjust an operating capacity (e.g., heating capacity, cooling capacity) of the integrated HVAC unit 102, such as instead of adjusting operation of the compressor 222. In this way, energy consumption of the HVAC system 100 may be reduced. In some embodiments, the integrated HVAC unit 102 may include additional one or more metering valves 244, separate from the EEV 218, that are configured to adjust the rate of refrigerant flow within the vapor compression system 214. Operation (e.g., control) of the EEV 218 (e.g., EEV actuator 219) may be synchronized with operation of the one or more metering valves 244 to achieve a desired flow rate within the vapor compression system 214. In some embodiments, the one or more metering valves 244 may be configured to direct the refrigerant within the vapor compression system 214 in a desired flow path. In this way, in some embodiments, the one or more metering valves may be disposed along the refrigerant circuit 226 between the EEV 218 and one or more of the AHU heat exchangers 224, and configured to adjust (e.g., control) a refrigerant flow rate within (e.g., direct to) each respective AHU heat exchanger 224. Additionally or alternatively, the one or more metering valves may be disposed along the refrigerant circuit 226 between the EEV 218 and one or more of the VRF heat exchangers 216, and configured to adjust (e.g., control) a refrigerant flow rate within (e.g., direct to) each respective VRF heat exchanger 216.

Furthermore, as discussed herein, the VRF section 200 may include the compressor 222 fluidly coupled to the vapor compression system 214 of the integrated HVAC unit 102 and configured to control a flow rate of the refrigerant through the vapor compression system 214, such as through the VRF heat exchanger 216, the expansion device 218, the reversing value 220, the refrigerant circuit 226, the AHU heat exchanger 224, or any combination thereof. The compressor 222 may be a variable speed compressor configured to selectively operate in various stages and/or speeds in a manner that enables the vapor compression system 214 to efficiently satisfy the cooling and/or heating thermal load of the conditioned space 104. For example, the compressor 222 may be an inverter driven digital scroll compressor configured to adjust (e.g., via signals received from the controller 212) a speed of the inverter driven digital scroll compressor to efficiently satisfy a cooling and/or heating thermal load of the conditioned space 104, such that the speed of the inverter driven digital scroll compressor directly affects the flow rate of the refrigerant through the vapor compression system 214. This technique of dynamically adjusting the speed of the compressor 222 to meet heating and/or cooling demands of the conditioned space 104 enables efficient adjustment of the flow rate of the refrigerant within the vapor compression system 214 to satisfy the cooling and/or heating demands of the thermal loads of the conditioned space 214, as opposed to conventional compressors that may simply cycle off and on (e.g., either operating at a constant speed or not operating at all) dependent on the heating and/or cooling demands of a conditioned environment. While the illustrated embodiment shows one compressor 222 (a single variable speed compressor), in some embodiments, the vapor compression system 214 may include any number of variable speed compressors (e.g., 2, 3, 4, 5, 10) to facilitate varying the flow rate of the refrigerant of the vapor compression system 214 to efficiently meet the heating and/or cooling demands of the conditioned space 104.

As discussed above, the VRF heat exchanger 216 and the AHU heat exchanger 224 are each configured to place a respective flow of refrigerant (e.g., flowing through the VRF heat exchanger 216 or the AHU heat exchanger 224) in a heat exchange relationship with a respective air flow (e.g., the first or second air flow 228, 230). Accordingly, the VRF section 200 and the AHU section 202 may each include one or more blowers (e.g., fans), one or more dampers, and/or one or more filters configured to draw, direct, control, and/or filter air flowing through the VRF section 200 and the AHU section 202. In particular, the VRF section 200 may include a blower 232 (e.g., VRF section blower) configured to draw air (e.g., the first air flow 228) into the VRF section 200 and across (e.g., through) the VRF heat exchanger 216. Furthermore, the VRF section 200 may include one or more dampers 234 (e.g., VRF section dampers) configured to dynamically adjust an air flow rate of an air flow (e.g., the first air flow 228) through the VRF section 200, such as a rate the first air flow 228 enters and/or exits the VRF section 200. In some embodiments, the VRF section 200 may include one or more filters 236 (e.g., VRF section filters) configured to filter an air flow (e.g., the first air flow 228) flowing through the VRF section 200. In some embodiments, the air flow entering the VRF section 200, such as the first air flow 228, may be outside air (e.g., air from a surrounding environment of the building 106).

Additionally, the AHU section 202 may include a blower 238 (e.g., AHU blower) configured to draw air (e.g., the second air flow 230) into the AHU section 202 and across (e.g., through) the AHU heat exchanger 224. In some embodiments, the AHU blower 238 may be positioned downstream of the AHU heat exchanger 224 with respect to an air flow direction of the second air flow 230, such that the AHU blower 238 is configured to draw air across the AHU heat exchanger 224. In other embodiments, the AHU blower 238 may be positioned upstream of the AHU heat exchanger 224 with respect to the air flow direction of the second air flow 230 and may therefore be configured to blow air across the AHU heat exchanger 224. Furthermore, the AHU section 202 may include one or more dampers 240 (e.g., AHU dampers) configured to dynamically adjust an air flow rate of an air flow (e.g., the second air flow 230), such as a rate the air flow enters and/or exits the AHU section 202. In particular, the AHU damper(s) 240 may control a rate of conditioned air flow entering the conditioned space 104 (e.g., a conditioning zone 116) of the building 106. In some embodiments, the AHU section 202 may include one or more filters 236 (e.g., AHU filters) configured to filter an air flow (e.g., the second air flow 230) flowing through the AHU section 202 and into the conditioned space 104. In some embodiments, the air flow entering the AHU section 202, such as the second air flow 230, may be outside air (e.g., air from a surround environment of the building 106), return air (e.g., air from the conditioned space 104), and/or a mixture of the outside air and return air.

Figure 3:
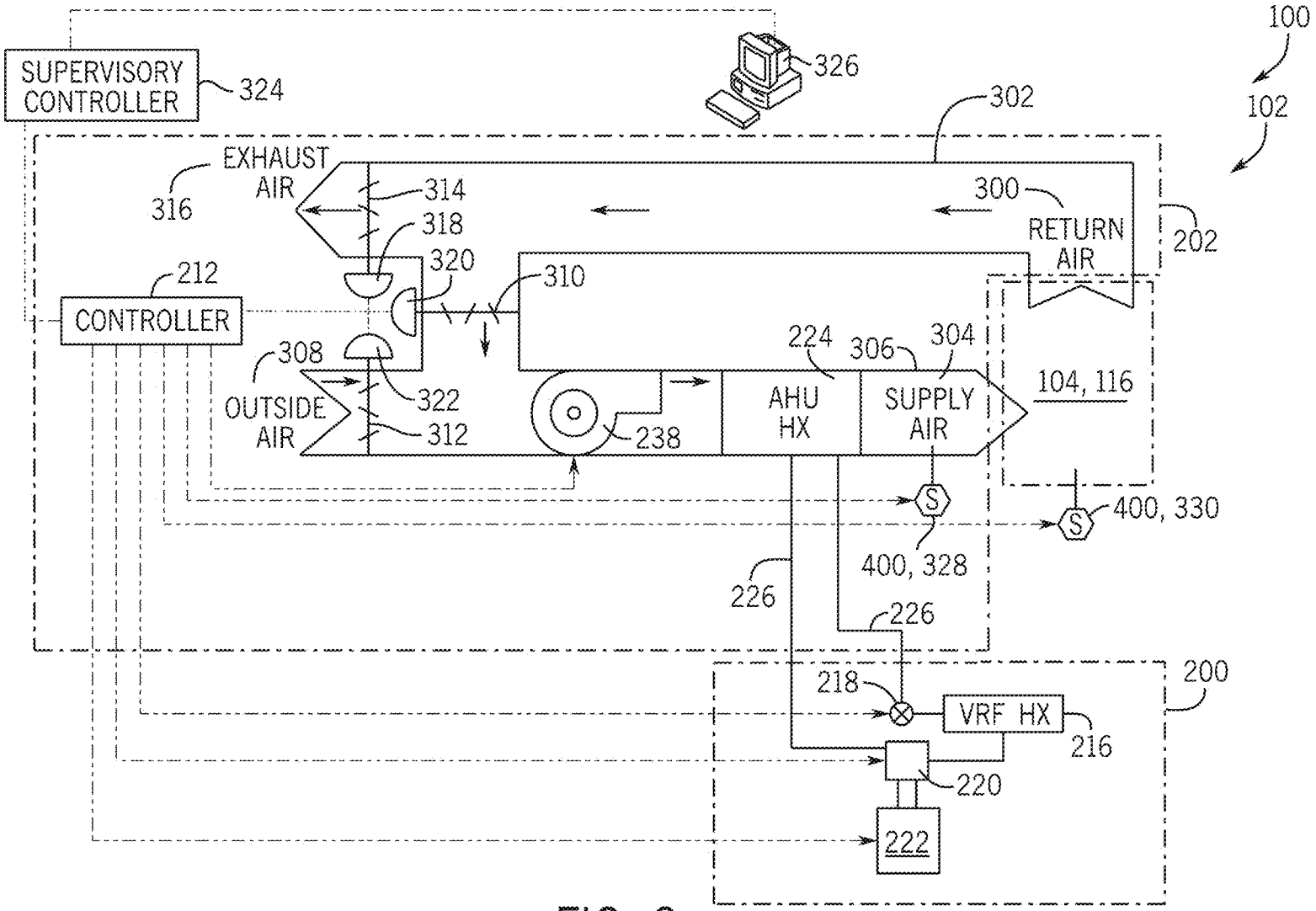
FIG. 3 is a schematic diagram of an embodiment of an integrated HVAC unit having a VRF unit and an AHU, in accordance with an aspect of the present disclosure.

FIG. 3 is a schematic diagram of an embodiment of the HVAC system 100 illustrating components of the integrated HVAC unit 102, including the AHU section 202 and the VRF section 200. In some embodiments, as discussed herein, the AHU section 202 may vary an amount of outside air (e.g., air from a surrounding environment of the building 106) and an amount of return air (e.g., air from the conditioned space 104) received by the AHU section 202 to be conditioned (e.g., heating, dehumidifying, and/or cooling) and supplied to the conditioned space 104. For example, in some embodiments, the AHU section 202 may receive return air 300 from the conditioned space 104 (e.g., the conditioning zone(s) 116) via one or more return air ducts 302 and may deliver supply air 304 to the conditioned space 104 (e.g., the conditioning zone(s) 116) via one or more supply air ducts 306. In other embodiments, the integrated HVAC unit 102 may be a rooftop unit located on a roof of a building (e.g., integrated HVAC unit 102 as shown in FIG. 1) or otherwise positioned such that the AHU section 202 receives both the return air 300 and outside air 308. Furthermore, the AHU section 202 may be configured to operate (e.g., via the controller 212) one or more dampers, such as a mixing damper 310 and/or an outside air damper 312, which may be disposed within the AHU section 202 to control the amounts and/or ratios of the return air 300 and the outside air 308 received, mixed, and conditioned by the AHU section 202 to create the supply air 304. Additionally, in some embodiments, the AHU section 202 may be configured to control (e.g., via the controller 212) an exhaust air damper 314 to control an amount of return air 300 that may be discharged from the integrated HVAC unit 102. For example, return air 300 that does not pass through mixing damper 310 (e.g., blocked by the mixing damper 310) may be exhausted from the AHU section 202 through exhaust damper 314 as exhaust air 316.

Each of the one or more dampers (e.g., the mixing damper 310, the outside air damper 312, and/or the exhaust damper 314) may be coupled to and operated by a respective actuator. For example, in the illustrated embodiment, the exhaust air damper 314 is operated by a first actuator 318, the mixing damper 310 is operated by a second actuator 320, and the outside air damper 308 is operated by a third actuator 322. The first, second, and third actuators 318, 320, 322 may be communicatively coupled to the controller 212 and be configured to receive one or more control signals from the controller 212. In some embodiments, the first, second, and third actuators 318, 320, 322 may receive control signals from the controller 212 and provide (e.g., transmit) feedback signals to the controller 212. The feedback signals may include, for example, an indication of a current actuator and/or damper position, an amount of torque or force exerted by the respective actuator, diagnostic information (e.g., results of diagnostic tests performed by the first, second, and third actuators 318, 320, 322), actuator and/or damper status information, commissioning information, configuration settings, calibration data, and/or other types of information or data that can be collected, stored, or used by the first, second, and third actuators 318, 320, 322. In some embodiments, the controller 212 may be an economizer controller configured to implement one or more control algorithms (e.g., state-based algorithms, extremum seeking control (ESC) algorithms, proportional-integral (PI) control algorithms, proportional-integral-derivative (PID) control algorithms, model predictive control (MPC) algorithms, feedback control algorithms, etc.) to control the first, second, and third actuators 318, 320, 322. While the illustrated embodiment presents three actuators coupled to three dampers, it should be understood that the AHU section 202 may include fewer or more actuators (e.g., 1, 2, 4, 5, 10) coupled to and operating fewer or more dampers (e.g., 1, 2, 4, 5, 10), such as, for example, a single actuator to operate two or more dampers.

Continuing with FIG. 3, the AHU section 202 is shown to include the AHU heat exchanger 224 and the AHU blower 238 positioned within the AHU section 202. As similarly illustrated in FIG. 2, the AHU blower 238 may be configured to blow (e.g., force) the outside air 308, the return air 300, or a combination of both across the AHU heat exchanger 224. As discussed herein, in some embodiments, the AHU blower 238 may be positioned downstream of the AHU heat exchanger 224 (e.g., with respect to an air flow direction of the outside air 308, the return air 300, or a combination of both through the AHU section 202) and configured to draw the outside air 308, the return air 300, or a combination of both across the AHU heat exchanger 224. Furthermore, the air flow may exit the AHU heat exchanger 224 as the supply air 304 and travel into the conditioned space 104 and/or conditioning zones 116 through the supply air ducts 306. In some embodiments, the supply air 304 may be provided directly to the conditioned space 104 and/or conditioning zones 116 (e.g., without the use of the supply ducts 306). The controller 212 may be communicatively coupled to the AHU blower 238 and configured to control a speed of the AHU blower 238 to control a flow rate of an air flow (e.g., the outside air 308, the return air 300, or a combination of both) across the AHU heat exchanger 224. In some embodiments, the controller 212 may control an amount of heating or cooling applied to the outside air 308, the return air 300, or a combination of both by modulating the speed of the AHU blower 238.

As discussed herein, the AHU heat exchanger 224 may be fluidly coupled to one or more other components of the vapor compression system 214 disposed within the VRF section 200. The AHU heat exchanger 224 may be configured to receive the refrigerant in the first flow direction during operation of the integrated HVAC unit 102 in the cooling mode to cool the outside air 308, the return air 300, or a combination of both, thereby producing a cooled supply air 304 provided to the conditioned space 104 (e.g., the conditioning zones 116). Additionally, the AHU heat exchanger 224 may be configured to receive the refrigerant in the second flow direction (e.g., opposite the first flow direction) during operation of the integrated HVAC unit 102 in the heating mode to heat the outside air 308, the return air 300, or a combination of both, thereby producing a heated supply air 304 provided to the conditioned space 104 (e.g., the conditioning zones 116). Furthermore, as discussed herein, the amount of cooling and/or heating may be modulated by adjusting a flow rate of the refrigerant within the vapor compression system 214 of the integrated HVAC unit 102. In this way, the integrated HVAC unit 102 may more efficiently satisfy a cooling and/or heating demand of the conditioned space 104 (e.g., the conditioning zones 116). In some embodiments, the controller 212 may be communicatively coupled to the compressor 222 and configured to dynamically modulate the speed of the compressor 222 (e.g., variable speed compressor) based on a cooling and/or heating demand.

For example, in the illustrated embodiment, the HVAC system 100 may include a supervisory controller 324 and a client device 326. The supervisory controller 324 may include one or more computer systems (e.g., servers, supervisory controllers, subsystem controllers, etc.) that serve as system level controllers, application or data servers, head nodes, or master controllers for the HVAC system 100, one or more of the integrated HVAC unit 102, and/or other controllable systems that serve building 106. The supervisory controller 324 may be communicatively coupled to and configured to communicate with and/or control operations of multiple downstream building systems or subsystems (e.g., HVAC system 100, a security system, a lighting system, the integrated HVAC unit 102, etc.). As discussed in more detail below, the supervisory controller 324 may communicate via one or more signals according to a communication protocol (e.g., LON, BACnet, etc.). The one or more signals may be transmitted through wired or wireless communications interfaces (e.g., jacks, antennas, transmitters, receivers, transceivers, wire terminals, etc.) and/or may be direct (e.g., local wired or wireless communications) or via a communications network (e.g., a WAN, the Internet, a cellular network, etc.). In some embodiments, the controller 212 and the supervisory controller 324 may be separate (as shown in FIG. 3) or integrated. In an integrated implementation, the controller 212 may be a software module configured for execution by a processor of the supervisory controller 324.

In some embodiments, the controller 212 receives information from the supervisory controller 324 (e.g., commands, setpoints, operating boundaries, etc.) and provides information to supervisory controller 324 (e.g., temperature and/or humidity measurements, valve or actuator positions, operating statuses, diagnostics, etc.). In particular, the controller 212 may be communicatively coupled to one or more sensors 400 disposed within the HVAC system 100. For example, as illustrated, a first sensor 328 may be disposed within the supply air duct 306 and configured to detect a first temperature and/or a first humidity of the supply air 304 within the supply air duct 306. Additionally, a second sensor 330 may be disposed within the conditioned space 104 (e.g., the conditioning zone 116) and configured to detect a second temperature and/or second humidity of ambient air within the conditioned space 104 (e.g., the conditioning zone 116). The first and/or second sensors 328, 330 may output signals including detected temperature and/or humidity measurements to the controller 212. Furthermore, the controller 212 may provide the supervisory controller 324 with temperature and/or humidity measurements from the first and second sensors 328, 330 to enable the supervisory controller 324 to monitor and/or adjust (e.g., via the controller 212) the temperature and/or humidity of the air within the conditioned space 104 (e.g., the conditioning zone 116). In some embodiments, the controller 212 may provide the supervisory controller 324 with information associated with components of the HVAC system 100 (e.g., dampers, blowers, the one or more components of the vapor compression system 214, AHU section 202, and/or VRF section 200, etc.) such as, for example, equipment on/off states, equipment operating capacities, and/or any other information that may be used by the supervisory controller 324 to monitor and/or control the temperature and/or humidity within the conditioned space 104 (e.g., the conditioning zone 116) of the building 106. In some embodiments and as discussed in more detail below, the supervisory controller 326 and/or the controller 212 may receive input from the one or more sensors 400 located within the HVAC system 100 (e.g., disposed in the integrated HVAC unit 102) and/or within the conditioned space/conditioning zone 104, 116 and may adjust a flow rate and/or a flow direction of the refrigerant within the vapor compression system 214, thus adjust a temperature of the supply air 304, adjust an air flow rate (e.g., via the blower 238, the one or more dampers 310, 312, 314, etc.), or other attributes of the supply air 304 produced by the integrated HVAC unit 102, based on the input from the one or more sensors 400, to achieve desired setpoint conditions (e.g., temperature and/or humidity) for the conditioned space/conditioning zone 104, 116.

Furthermore, the client device 326 may include one or more human-machine interfaces or client interfaces (e.g., graphical user interfaces, reporting interfaces, text-based computer interfaces, client-facing web services, web servers that provide pages to web clients, etc.) for controlling, viewing, or otherwise interacting with HVAC system 100, one or more of the integrated HVAC unit 102, its subsystems, and/or devices. The client device 326 may be a computer workstation, a client terminal, a remote device, a remote or local interface, or any other type of user interface device. In some embodiments, the client device 326 may be a stationary terminal or a mobile device. For example, client device 326 can be a desktop computer, a computer server with a user interface, a laptop computer, a tablet, a smartphone, a PDA, or any other type of mobile or non-mobile device. In the illustrated embodiment, the client device 268 is communicatively coupled to the supervisory controller 324 and the controller 212 (e.g., via the supervisory controller 324). The client device 268 may be configured to transmit signals (e.g., control signals) and/or receive signals (e.g., feedback signals) from the supervisory controller 324 and/or the controller 212 to enable the client device 326 to monitor and/or control the temperature and/or humidity within the conditioned space 104 (e.g., the conditioning zone 116) of the building 106.

Figure 4:
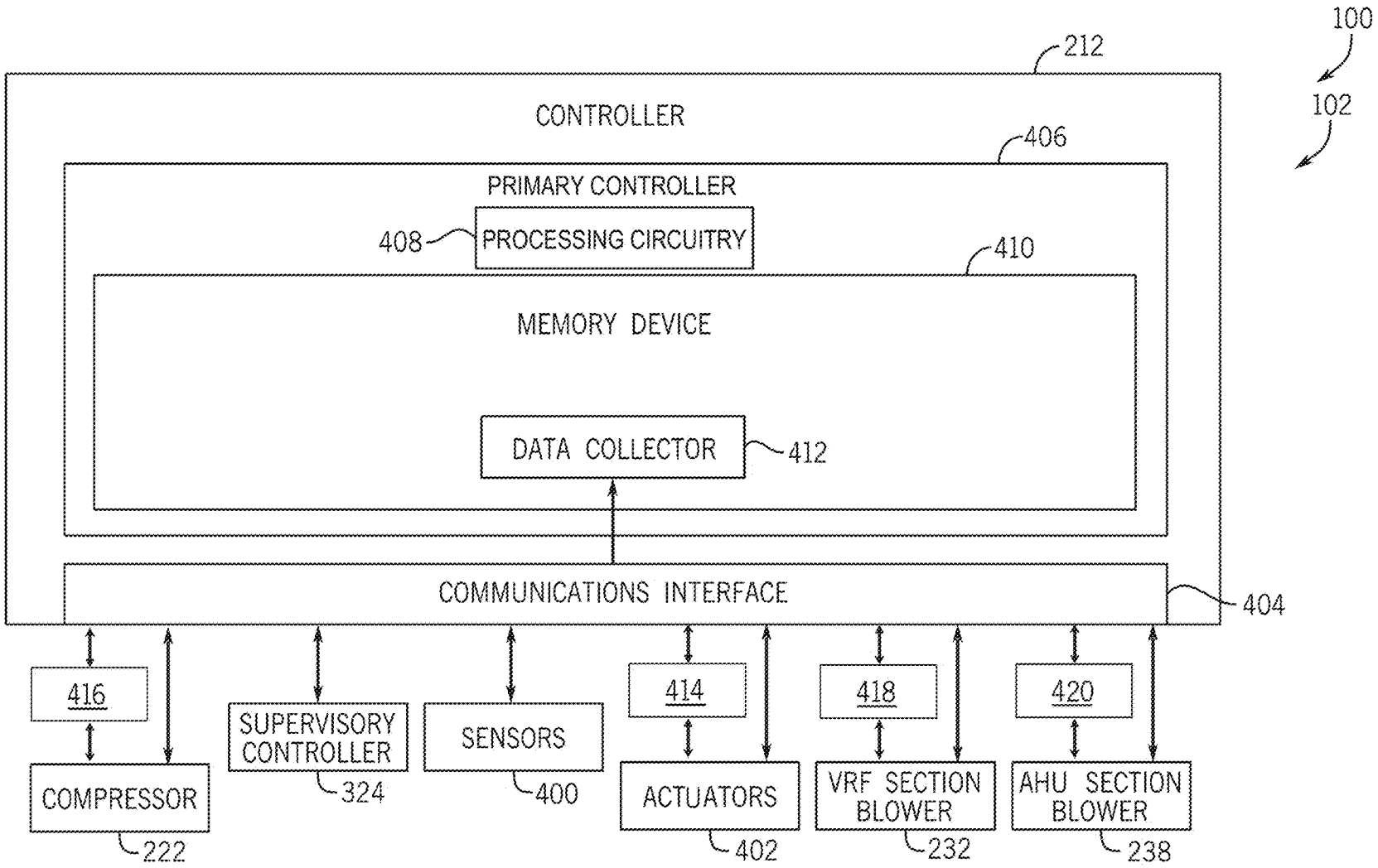
FIG. 4 is a block diagram of an embodiment of a centralized controller of an integrated HVAC unit having a VRF unit and an AHU, in accordance with an aspect of the present disclosure.

FIG. 4 is a block diagram of an embodiment of the centralized controller 212 (e.g., control system) of the integrated HVAC unit 102 of the HVAC system 100. The controller 212 may be configured to monitor and control various components of HVAC system 100 (e.g., the integrated HVAC unit 102) using any of a variety of control techniques (e.g., state-based control, on/off control, proportional control, proportional-integral (PI) control, proportional-integral-derivative (PID) control, extremum seeking control (ESC), model predictive control (MPC), etc.). Furthermore, as discussed herein, the controller 212 may receive desired temperature and/or humidity setpoints from one or more of the control devices 130 and/or the supervisory controller 324, as well as temperature and/or humidity measurements from the one or more sensors 400, including, for example, the first and/or second sensors 328, 330. Based on the data and/or feedback received, the controller 212 may provide (e.g., output) control signals to the various components of the HVAC system 100 (e.g., VRF section 200, AHU section 202), including the vapor compression system 214, the first, second, and third actuators 310, 312, 314, the blower 238, the expansion value 218, the reversing valve 220, the variable speed compressor 222, and so forth, to dynamically adjust an air flow rate and/or a refrigerant flow rate within the HVAC system 100 (e.g., the integrated HVAC unit 102) and/or the vapor compression system 214 to enable efficient satisfaction of the desired temperature and/or humidity setpoints. In this way, the HVAC system 100 may efficiently meet a thermal (e.g., heating and/or cooling) load of the conditioned space/conditioning zones 104, 116.

The one or more sensors 400 communicatively coupled to the controller 212 may include the first and second sensors 328, 330 illustrated in FIG. 3 and/or any other sensor configured to monitor various operating conditions of the HVAC system 100, such as operating conditions within the integrated HVAC unit 102, the conditioned space/conditioning zones 104, 116, a surrounding environment of the building 106, or any combination thereof. The one or more sensors 400 may additionally or alternatively monitor various operational states of components of the HVAC system 100 (e.g., the integrated HVAC unit 102). In some embodiments, the various conditions may include, for example, conditioning zone air temperature, conditioning zone air humidity, conditioning zone occupancy, conditioning zone CO2 levels, conditioning zone particulate matter (PM) levels, outdoor air temperature, outdoor air humidity, outdoor air CO2 levels, outdoor air PM levels, damper positions, valve positions, VRF blower status, AHU blower status, supply air temperature, supply air flow rate, refrigerant flow rate, variable compressor speed, reversing valve status, expansion device status, or any combination thereof.

Furthermore, one or more actuators 402 may be communicatively coupled to the controller 212 and configured to adjust one or more of the components of the HVAC system 100. The one or more actuators 402 may receive control signals from the controller 212 and may be configured to adjust an operational state of the one or more components of the HVAC system 100 (e.g., the integrated HVAC unit 102) based on the control signals. For example, the one or more actuators 402 may include the first actuator 318 associated with and configured to operate the exhaust air damper 314, the second actuator 320 associated with and configured to operate the mixing damper 310, the third actuator 322 associated with and configured to operate the outside air damper 312, the EEV actuator 219 associated with and configured to operate the EEV 218, and/or the ERV actuator 221 associated with and configured to operate the ERV 220. The one or more actuators 402 may receive the control signals from the controller 212 and/or may provide feedback signals to the controller 212 indicative of an operational state of the component associated with the one or more actuator 402.

As discussed herein, the controller 212 may additionally be communicatively coupled to the compressor 222, the AHU blower 238, and/or the VRF blower 232 of the integrated HVAC unit 102 and configured to control an operational state of the compressor 222, the AHU blower 238, and/or the VRF blower 232. In particular, the controller 212 may enable efficient operation (e.g., maintaining a desired temperature and/or humidity setpoint of the conditioned space/conditioning zone 104, 116) of the integrated HVAC unit 102 by controllably adjusting components of the integrated HVAC unit 102 via outputting control signals to the one or more actuators 402, the compressor 222, the AHU blower 238, and/or the VRF blower 232 based on feedback signal received from the one or more sensors 400. In some embodiments, the control signals may include commands (e.g., instructions) for the one or more actuators 402 to set dampers (e.g., the outside air, exhaust air, mixing dampers 312, 314, 310), and/or valves, such as the EEV 218 and the ERV 220, to specific operational positions to achieve an operational target value for an operational condition of the HVAC system 100 (e.g., supply air temperature, supply air humidity, relative proportions of the outside air and/or return air in the AHU section 202, refrigerant flow rate, refrigerant flow direction, etc.). In some embodiments, the control signals may include commands (e.g., instructions) for blowers (e.g., the AHU and/or VRF blowers 232, 238) to operate a specific operating speed and/or to achieve a specific air flow rate. Moreover, in some embodiments, the control signals may include commands (e.g., instructions) for the variable speed compressor 222 to operate at a specific operating speed and/or to achieve a specific refrigerant flow rate. As illustrated, the control signals may be provided to the one or more actuators 400, the AHU and/or VRF blowers 238, 232, and/or to the variable speed compressor 222 via a communications interface 404.

Moreover, the controller 212 may receive various inputs via the communications interface 404. The inputs received by the controller 212 may include desired temperature and/or humidity setpoints from the supervisory controller 324, measurements from the one or more sensors 400, such as air temperature and/or humidity measurements, air quality, a measured or observed position and/or operational status of the first, second, and/or third dampers 310, 312, 314, a measured or observed position and/or operational status of the expansion device 218 and/or the reversing valve 220, a measured or calculated amount of power consumption, a measured or observed blower speed (e.g., of the AHU blower 238 and/or the VRF blower 232), data (e.g., setpoints) from one or more control devices 130, refrigerant flow rate, refrigerant flow direction, refrigerant temperature and/or pressure, or any combination thereof. In some embodiments, the controller 212 may include control logic to determine the outputted control signals based on a target outcome (e.g., target operating parameter to be achieved). For example, the control logic implemented by the controller 212 may control the operations of the components of the integrated HVAC unit 102 based on a comparison between an operational state determined by the various inputs received from the one or more components of the HVAC system 100 and a received and/or stored desired operating condition setpoint, such as a desired setpoint temperature and/or humidity. The desired operational setpoint may be received from a user input (e.g., via a thermostat), the supervisory controller 324, and/or another upstream device via a communications network (e.g., a BACnet network, a LonWorks network, a LAN, a WAN, the Internet, a cellular network, etc.).

Still referring to FIG. 4, as discussed herein, the controller 212 may include the communications interface 404 configured to facilitate transmission of output control signals to the components of the HVAC system 100 (e.g., the integrated HVAC unit 102) and/or reception of input signals indicative of measurements of the operating conditions of the components and/or of desired operational setpoints of the HVAC system 100. The communications interface 404 may include wired or wireless communications interfaces (e.g., jacks, antennas, transmitters, receivers, transceivers, wire terminals, etc.) for conducting data communications with various components of the HVAC system 100 (e.g., the integrated HVAC unit 102) or other external systems or devices. In some embodiments, communications via the communications interface 404 may be direct (e.g., local wired or wireless communications) or via a communications network (e.g., a WAN, the Internet, a cellular network, etc.). For example, the communications interface 404 may include an Ethernet card and port for sending and receiving data via an Ethernet-based communications link or network. In another example, the communications interface 404 may include a Wi-Fi transceiver for communicating via a wireless communications network. In another example, the communications interface 404 may include a cellular or mobile phone transceiver, a power line communications interface, an Ethernet interface, or any other type of communications interface.

In some embodiments, the controller 212 may include a primary controller 406 (e.g., main controller) including processing circuitry 408 and a memory device 410. The processing circuitry 408 may be one or more general purpose or specific purpose processors, an application specific integrated circuit (ASIC), one or more field programmable gate arrays (FPGAs), a group of processing components, or other suitable processing components. The processing circuitry 408 may be configured to execute computer code or instructions stored in the memory device 410 and/or received from other computer readable media (e.g., CDROM, network storage, a remote server, etc.).

The memory device 410 may include one or more devices (e.g., memory units, memory devices, storage devices, etc.) for storing data and/or computer code for completing and/or facilitating the various processes and/or techniques described herein. The memory device 410 may include random access memory (RAM), read-only memory (ROM), hard drive storage, temporary storage, non-volatile memory, flash memory, optical memory, or any other suitable memory for storing software objects and/or computer instructions. The memory device 410 may include database components, object code components, script components, or any other type of information structure for supporting the various activities and information structures described in the present disclosure. Furthermore, the memory device 410 may be communicably connected to processing circuitry 408 and may include computer code for executing (e.g., by the processing circuitry 408) one or more processes and/or techniques described herein.

In some embodiments, the memory device 410 may include one or more functional components (e.g., stored instructions or programs) that enable the controller 212 to monitor and control the components of the HVAC system 100, as described herein. For example, in the illustrated embodiment, the memory device 410 is shown to include a data collector 412 which operates to collect data via the various input signals received by the communications interface 404 (e.g., desired operational setpoints, temperature, humidity and/or pressure measurements, feedback from the one or more actuators 402, the VRF blower 232, the AHU blower 238, and/or the compressor 222, etc.). The data collector 412 may receive, analyze, compare, and/or interpret the collected data for the controller 212. The controller 212 may then generate control signals based on the collected data to output to and adjust the components of the HVAC system 100. The particular type of control methodology used by the controller 212 (e.g., state-based control, PI control, PID control, ESC, MPC, etc.) may vary depending on the configuration of the controller 212 and may be adapted for various implementations.

In some embodiments, the controller 212 may include the primary controller 406 configured to perform some or all of the functions and operations described herein. For example, the primary controller 406 may be configured to control operation of the actuators 402, compressor 222, VRF section blower 232, AHU section blower 238, and so forth. In other embodiments, the controller 212 (e.g., control system) may include one or more controllers in addition to the primary controller 406. For example, the controller 212 may be a centralized control system of the integrated HVAC unit 102 that includes the primary controller 406 and one or more additional controllers (e.g., dedicated controllers), such as an actuator controller 414, a compressor controller 416, a VRF section blower controller 418, and an AHU section blower controller 420 that are each configured to control a respective or corresponding component of the integrated HVAC unit 102. In some embodiments, the one or more additional controllers may be communicatively coupled to the primary controller 406 and may be configured to send data and/or control signals to the primary controller 406, receive and/or control signals from the primary controller 406. Additionally or alternatively, the one or more additional controllers may receive data from any of the sensors described herein and/or may send or receive data to another controller of the HVAC system 100, such as the supervisory controller 324.

Figure 5:
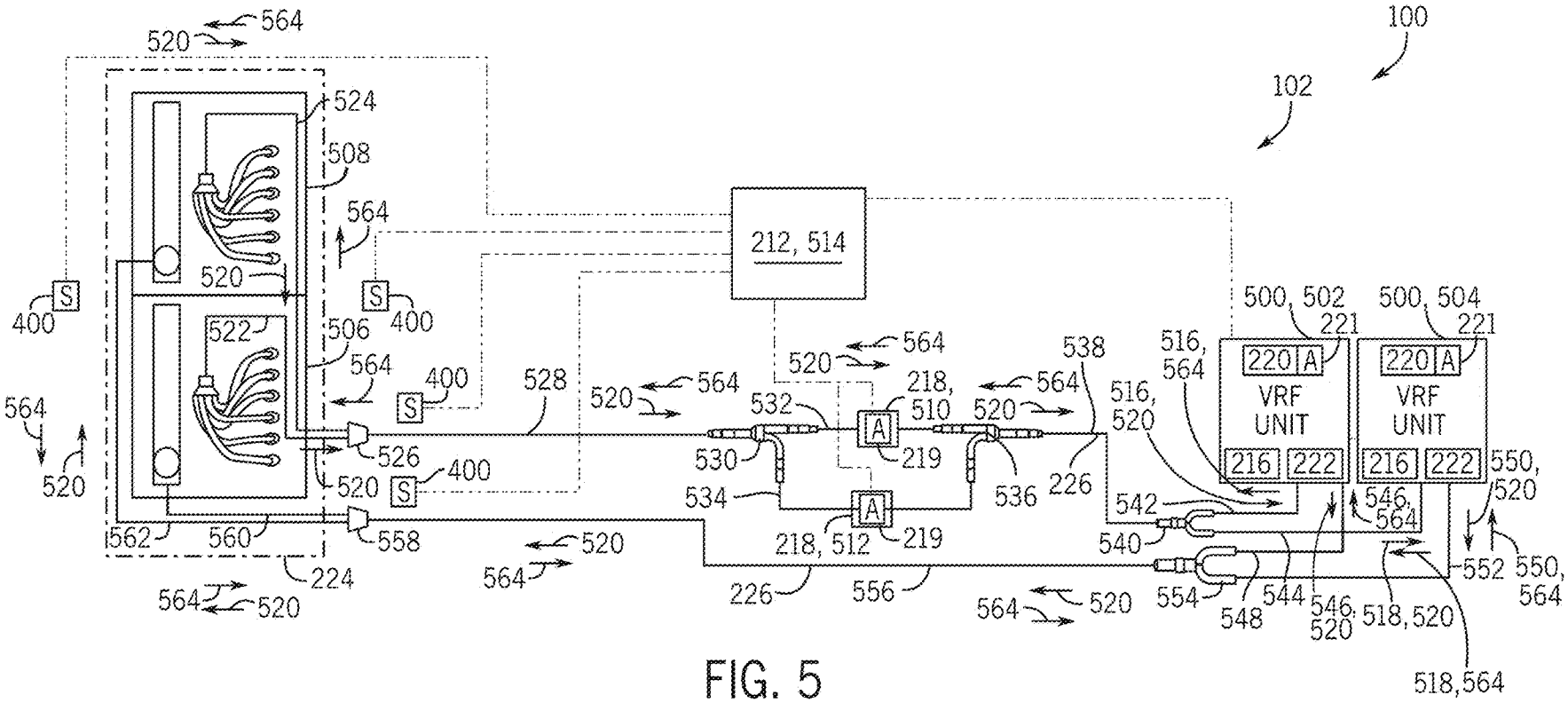
FIG. 5 is a schematic diagram of an embodiment of an integrated HVAC unit having a VRF unit and an AHU, in accordance with an aspect of the present disclosure.

FIG. 5 is a schematic diagram of an embodiment of the integrated HVAC unit 102 of the HVAC system 100 illustrating various connections between components of the integrated HVAC unit 102. For example, the integrated HVAC unit 102 may be a 25 ton packaged, integrated HVAC unit 102 (e.g., rooftop unit) including two VRF units 500, such as a first VRF unit 502 and a second VRF unit 504, fluidly coupled to a first and a second coil 506, 508 (e.g., stacked first and second coils, face split coil configuration, vertically stacked, substantially perpendicular to a direction of air flow across the AHU heat exchanger 224) of the AHU heat exchanger 224 (e.g., within the AHU section 202), and a first and second EEV 510, 512 via the refrigerant circuit 226. The integrated HVAC unit 102 may include a centralized controller 514 (e.g., the controller 212) communicatively coupled to and configured to control and/or receive feedback from the components of the illustrated integrated HVAC unit 102, such as the first and second VRF units 502, 504, first and second EEVs 510, 512, one or more EEV actuators 219, and one or more sensors 400, using the techniques discussed herein. Furthermore, each of the first and second VRF units 502, 504 may include a respective compressor 222, VRF heat exchanger 216, reversing value 220 (e.g., ERV 220), and/or ERV actuator 221. As discussed herein, during operation in the heating mode, the first and second VRF units 502, 504 may receive a first portion 516 of refrigerant flow and a second portion of refrigerant flow 518, respectively, (e.g., from the AHU section 202) in a first refrigerant flow direction 520. As illustrated, refrigerant may exit the first and second coils 506, 508 of the AHU heat exchanger 224 via a first segment 522 of the refrigerant circuit 226 and a second segment 524 of the refrigerant circuit 226, respectively, in the first refrigerant flow direction 520. Each of the first and second segments 522, 524 may direct respective portions of the refrigerant flow. The first and second segments 522, 524 may join at a first header assembly 526 (e.g., first header) configured to combine the portion of the refrigerant flow from the first segment 522 and the portion of the refrigerant flow from the second segment 524 into a common refrigerant flow directed to a third segment 528 of the refrigerant circuit 226, with the refrigerant flow directed in the first refrigerant flow direction 520.

Moreover, the refrigerant within the third segment 528 may flow through a first valve 530 (e.g., check valve) configured to direct the refrigerant flow (e.g., in the first refrigerant flow direction 520) into a fourth segment 532 of the refrigerant circuit 226 (e.g., and block refrigerant flow through a fifth segment 534 of the refrigerant circuit 226 and block refrigerant flow into the second EEV 512) and, thus, through the first EEV 510 (e.g., EEV 218). The refrigerant from the fourth segment 532 may be directed through the first EEV 510 and may flow through a second valve 536 (e.g., check valve) configured to direct the refrigerant flow (e.g., in the first refrigerant flow direction 520) into a sixth segment 538 of the refrigerant circuit 226 in the first refrigerant flow direction 520. Then the refrigerant within the sixth segment 538 and in the first refrigerant flow direction 520 may enter a first separation tube 540 configured to divide (e.g., split) the refrigerant flow into the first portion 516 of the refrigerant flow directed through a seventh segment 542 of the refrigerant circuit 226 toward the first VRF unit 502 and the second portion 518 of the refrigerant flow directed through an eighth segment 544 of the refrigerant circuit 226 toward the second VRF unit 504.

Furthermore, when operating in the heating mode, the first VRF unit 502 may direct a third portion 546 of the refrigerant flow through a ninth segment 548 of the refrigerant circuit 226, and the second VRF unit 504 may direct a fourth portion 550 of the refrigerant flow through a tenth segment 552 of the refrigerant circuit 226. The third and fourth portions 546, 550 of the refrigerant flow may be directed towards the AHU heat exchanger 224. In particular, as illustrated, the third and fourth portion 546, 550 of the refrigerant flow may enter a second separation tube 554 configured to combine the third and fourth portion 546, 550 of the refrigerant flow and direct the combined refrigerant flow into an eleventh segment 556 of the refrigerant circuit 226 along the first refrigerant flow direction 520 towards the first and second coils 506, 508 of the AHU heat exchanger 224. The refrigerant within the eleventh segment 556 and flowing in the first refrigerant flow direction 520 may enter a second header assembly 558 (e.g., header) configured to divide (e.g., separate) the refrigerant within the eleventh segment 556 into respective portions of refrigerant directed to and received by the first and second coils 506, 508. In particular, the second header assembly 558 may divide the refrigerant flow (e.g., when flowing in the first refrigerant flow direction 520) within the eleventh segment 556 into a first portion of the refrigerant within a twelfth segment 560 of the refrigerant circuit 226 fluidly coupled to the first coil 506 and a second portion of the refrigerant with in a thirteenth segment 562 of the refrigerant circuit 226 fluidly coupled to the second coil 508.

As discussed herein, the direction of refrigerant flow may be reversed (e.g., via the reversing valves 220, ERVs 220), such that during operation in the cooling mode, each of the first and second VRF units 502, 504 may respectively receive the third and fourth portions 546, 550 of the refrigerant flowing in a second refrigerant flow direction 564 (e.g., opposite the first refrigerant flow direction 520) from the first and second coils 506, 508 (e.g., the AHU heat exchanger 224), and respectively direct the first portion 516 and second portion 518 of the refrigerant flow in the second refrigerant flow direction 564 towards the first and second coils 506, 508 of the AHU heat exchanger 224. In the second refrigerant flow direction 564, the refrigerant may flow through the second EEV 512 instead of the first EEV 510. For example, refrigerant may exit the first and second coils 506, 508 of the AHU heat exchanger 224 in the second refrigerant flow direction 564 via the twelfth segment 560 and the thirteenth segment 562 of the refrigerant circuit 226, respectively. The refrigerant may then enter the second header assembly 558 configured to combine the respective portions of the refrigerant from the twelfth and thirteenth segments 560, 562 into a common refrigerant flow within the eleventh segment 556 with the refrigerant flowing in the second refrigerant flow direction 564. Furthermore, the refrigerant flowing the second refrigerant flow direction 564 and within the eleventh segment 556 may enter the second separation tube 554 configured to divide the refrigerant flow within the eleventh segment 556 into the third portion 546 directed to and received by the first VRF unit 502 and the fourth portion 550 directed to and received by the second VRF unit 504.

Moreover, when operating in the cooling mode, the first and second VRF units 502, 504 may direct the first portion 516 of the refrigerant flow through the seventh segment 542 of the refrigerant circuit 226 and the second portion 518 of the refrigerant flow through the eighth segment 544 of the refrigerant circuit 226, respectively, toward the first and second coils 506, 508 (e.g., the AHU heat exchanger 224) in the second refrigerant flow direction 564. In particular, as illustrated, the first and second portions 516, 518 of the refrigerant flow discharged by the first and second VRF units 502, 504 may enter the first separation tube 540 configured to combine the first and second portions 516, 518 of the refrigerant flow and direct the combined refrigerant flow into the sixth segment 538 of the refrigerant circuit 226 in the second refrigerant flow direction 564 (e.g., toward the AHU heat exchanger 224). The refrigerant within the sixth segment 538 and flowing in the second refrigerant flow direction 564 may enter the second valve 536 (e.g., check valve) configured to direct the refrigerant flow (e.g., when in the second refrigerant flow direction 564) into the fifth segment 534 of the refrigerant circuit 226 (e.g., and block refrigerant flow into the fourth segment 532 of the refrigerant circuit 226 and block refrigerant flow through the first EEV 510). Thus, the refrigerant may flow through the second EEV 512 (e.g., EEV 218). The refrigerant within the fifth segment 534 may exit the second EEV 512 and flow through the first valve 530 (e.g., check valve) configured to direct the refrigerant flow (e.g., when in the second refrigerant flow direction 564) into the third segment 528 of the refrigerant circuit 226 and in the second refrigerant flow direction 564. Then the refrigerant within the third segment 528 may enter the first header assembly 526 configured to divide (e.g., split) the refrigerant flow within the third segment 528 into respective portions directed through the first and second segments 522, 524 of the refrigerant circuit 226 and directed to the first and second coils 506, 508 of the AHU heat exchanger 224.

Figure 6:
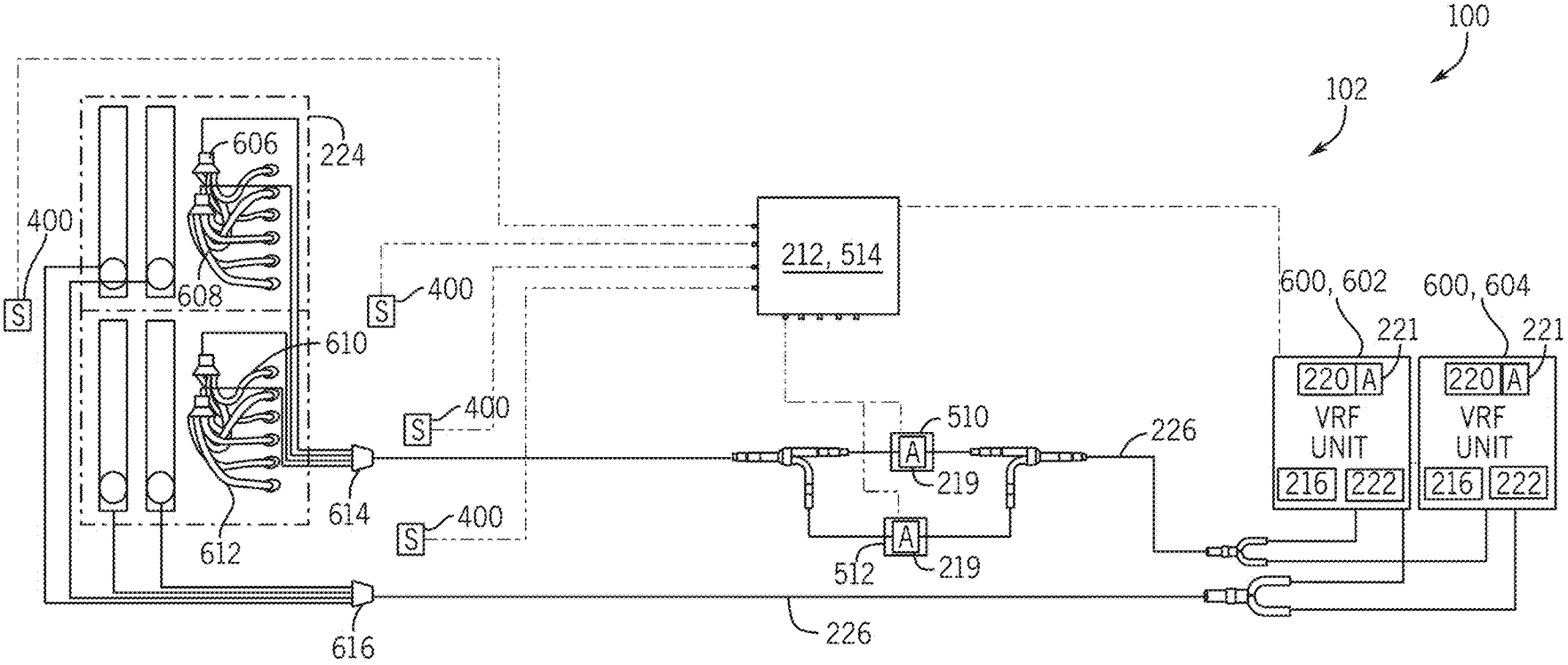
FIG. 6 is a schematic diagram of an embodiment of an integrated HVAC unit having a VRF unit and an AHU, in accordance with an aspect of the present disclosure.

FIG. 6 is a schematic diagram of an embodiment of the integrated HVAC unit 102 of the HVAC system 100 illustrating connections between the components of the integrated HVAC unit 102. For example, the integrated HVAC unit 102 may be a 30 ton packaged, integrated HVAC unit 102 including components similarly described above with reference to FIG. 5. For example, the illustrated embodiment includes two VRF units 600, such as a first VRF unit 602 and a second VRF unit 604, fluidly coupled to a first, a second, a third, and a fourth coil 606, 608, 610, 612 of the AHU heat exchanger 224 (e.g., within the AHU section 202). In particular, in the illustrated embodiment, the first and second coils 606, 608 are arranged in a face-to-face configuration (e.g., a row split configuration) and are stacked on the third and fourth coils 610, 612 (e.g., face split configuration, vertically stacked, substantially perpendicular to a direction of air flow across the AHU heat exchanger 224), which are also arranged in a face-to-face configuration. As similarly discussed with reference to FIG. 5, the integrated HVAC unit 102 may additionally include the first and second EEVs 510, 512, the first and second VRF units 602, 604, and the first, second, third, and fourth coils 606, 608, 610, 612, and the first and second EEV 510, 512 may be fluidly coupled via the refrigerant circuit 226. The integrated HVAC unit 102 may include a centralized controller 514 (e.g., the controller 212) communicatively coupled to and configured to control and/or receive feedback from the components of the integrated HVAC unit 102, such as the first and second VRF units 602, 604 (e.g., having respective compressors 222, reversing valves 220, ERV actuators 221), the first and second EEVs 510, 512, one or more EEV actuators 219, and one or more sensors 400, using the techniques discussed herein. Furthermore, each of the first and second VRF units 602, 604 may include a respective compressor 222, VRF heat exchanger 216, a reversing value 220 (e.g., ERV 220), and/or an ERV actuator 221.

The refrigerant circuit 226 of the integrated HVAC unit 102 of FIG. 6 may operate in a manner similar to that described above regarding the refrigerant circuit 226 of the integrated HVAC unit 102 of FIG. 5 in the heating and/or cooling modes. However, in the illustrated embodiment, instead of the first and second header 526, 558 of FIG. 5, the integrated HVAC unit 102 includes a first and a second header assembly 614, 616 (e.g., a four-way header assembly) configured to combine respective refrigerant flows exiting the first, the second, the third, and the fourth coils 606, 608, 610, 612 into a single refrigerant flow directed towards the first and second VRF units 602, 604 and/or split (e.g., separate) the refrigerant flow (e.g., from the first and second VRF units 602, 604) into a first, a second, a third, and a fourth respective portion of the refrigerant flow and direct the respective portions to the respective first, second, third, and fourth coils 606, 608, 610, 612, depending on the refrigerant flow direction and operating mode of the integrated HVAC unit 102.

Figure 7:
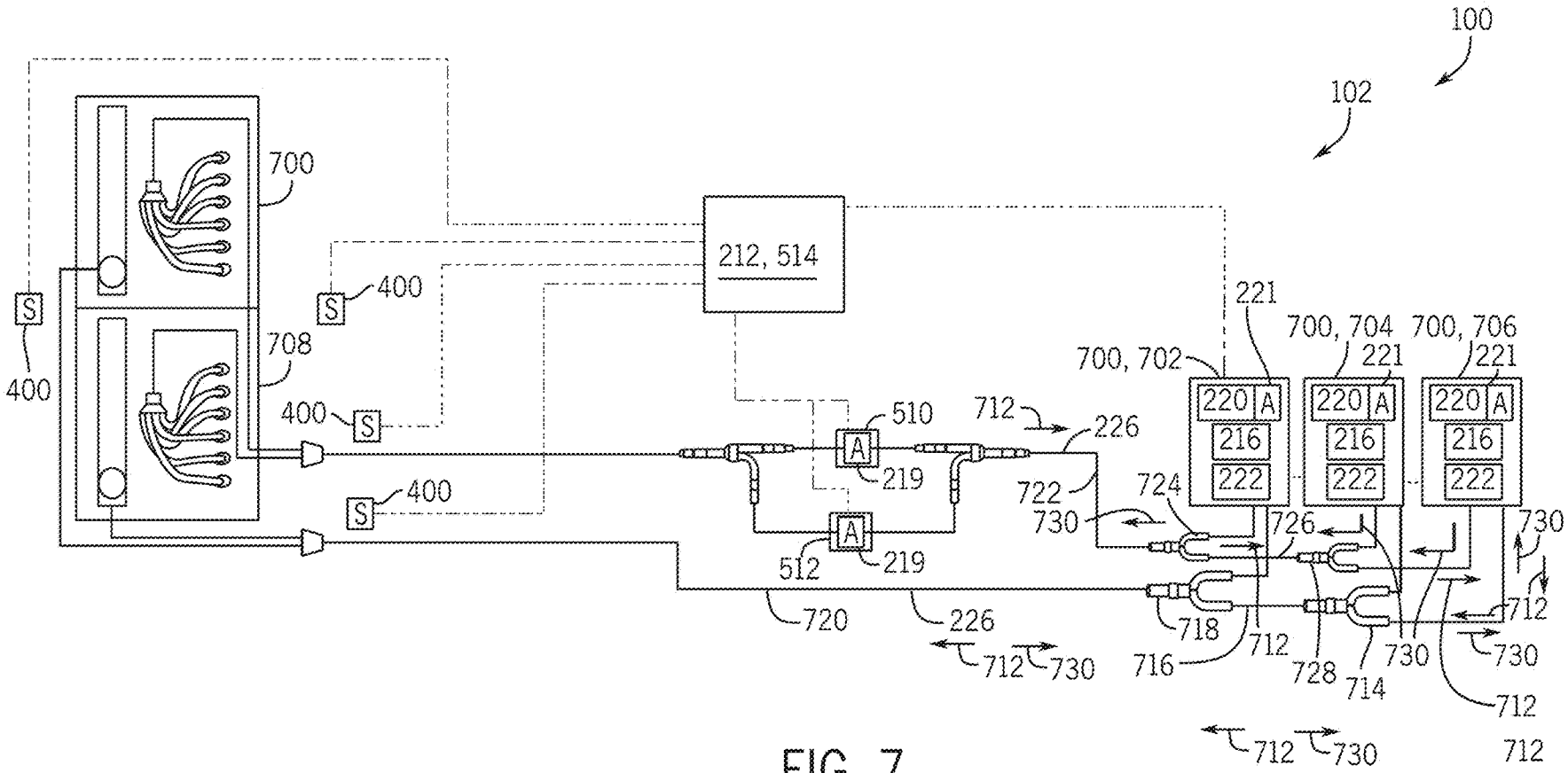
FIG. 7 is a schematic diagram of an embodiment of an integrated HVAC unit having a VRF unit and an AHU, in accordance with an aspect of the present disclosure.

FIG. 7 is a schematic diagram of an embodiment of the integrated HVAC unit 102 of the HVAC system 100 illustrating connections between the components of the integrated HVAC unit 102. For example, the integrated HVAC unit 102 may be a 36 ton packaged integrated HVAC unit 102 including components similar to those discussed above with reference to FIG. 5, and further including three VRF units 700, such as a first VRF unit 702, a second VRF unit 704, and a third VRF unit 706, fluidly coupled to a first and a second coil 708, 710 of the AHU heat exchanger 224 (e.g., within the AHU section 202). In particular, in the illustrated embodiment, the first and second coils 708, 710 are arranged in a stacked configuration (e.g., face split configuration) with one on top of the other (e.g., vertically stacked, substantially perpendicular to a direction of air flow across the AHU heat exchanger 224). As similarly discussed with reference to FIG. 5, the integrated VRF-AHU 102 may additionally include the first and second EEVs 510, 512. The first, second, and third VRF units 702, 704, 706, the first and the second coils 708, 710, and the first and second EEV 510, 512 may be fluidly coupled via the refrigerant circuit 226. The integrated HVAC unit 102 may include the centralized controller 514 (e.g., the controller 212) communicatively coupled to and configured to control and/or receive feedback from the components of the packaged integrated HVAC unit 102, such as the first, second, and third VRF units 702, 704, 706 (e.g., having respective compressors 222, reversing valves 220, ERV actuators 221), the first and second EEVs 510, 512, one or more EEV actuators 219, and one or more sensors 400, using the techniques discussed herein. Furthermore, each of the first, second, and third VRF units 702, 704, 706 may include a respective compressor 222, VRF heat exchanger 216, a reversing value 220 (e.g., ERV 220), and/or an ERV actuator 221.

The refrigerant circuit 226 of the integrated HVAC unit 102 of FIG. 7 may operate in a manner similar to that described above regarding the refrigerant circuit 226 of the integrated HVAC unit 102 of FIG. 5 in the heating and/or cooling modes. However, in the illustrated embodiment, the integrated HVAC unit 102 includes the refrigerant circuit 226 with additional separation tubes to enable fluid coupling of the additional (e.g., third) VRF unit (e.g., third VRF unit 706). In particular, when refrigerant within the refrigerant circuit 226 is flowing in a first refrigerant flow direction 712 (e.g., in a heating mode of the integrated HVAC unit 102), respective portions of refrigerant flow from the second and the third VRF units 704, 706 may be combined by a first separation tube 714 into a common refrigerant flow within a first segment 716 of the refrigerant circuit 226. Furthermore, the refrigerant in the first segment 716 may be combined with a respective portion of refrigerant from the first VRF unit 702 via a second separation tube 718 to form a common refrigerant flow within a second segment 720 of the refrigerant circuit 226. The refrigerant is then directed towards the first and second coils 708, 710, as similarly discussed above with reference to FIG. 5. Additionally, when the refrigerant is flowing in the first refrigerant flow direction 712, a single flow of refrigerant within a third segment 722 of the refrigerant circuit 226 may be split (e.g., separated) by a third separation tube 724 into a portion direct to and received by the first VRF unit 702 and a portion within a fourth segment 726 of the refrigerant circuit 226 directed towards the second and third VRF units 704, 706. In particular, the portion of refrigerant flowing in the first refrigerant flow direction 712 within the fourth segment 726 may enter a fourth separation tube 728 configured to split (e.g., separate) the refrigerant flow into a portion directed to and received by the second VRF unit 704 and a portion directed to and received by the third VRF unit 704.

When the refrigerant is flowing in a second refrigerant flow direction 730, opposite the first refrigerant flow direction 712 (e.g., in a cooling mode of the integrated HVAC unit 102), respective portions of refrigerant flow from the second and the third VRF units 704, 706 may be combined by the fourth separation tube 726 into a common refrigerant flow within the fourth segment 726 of the refrigerant circuit 226. Furthermore, the refrigerant in the fourth segment 726 may be combined with a respective portion of refrigerant from the first VRF unit 702 via the third separation tube 724 to a single refrigerant flow within the third segment 722 of the refrigerant circuit 226, when in the second refrigerant flow direction 730. The refrigerant is then directed towards the first and second coils 708, 710, similarly as discussed with reference to FIG. 5. Additionally, when the refrigerant is flowing the second refrigerant flow direction 730, a single flow of refrigerant within the second segment 720 of the refrigerant circuit 226 may be split (e.g., separated) by the second separation tube 718 into a portion direct to and received by the first VRF unit 702 and a portion within the first segment 716 of the refrigerant circuit 226 directed towards the second and third VRF units 704, 706. In particular, the portion of refrigerant flowing in the second refrigerant flow direction 730 with the first segment 716 may enter the first separation tube 714 configured to split (e.g., separate) the refrigerant flow into a portion direct to and received by the second VRF unit 704 and a portion direct to and received by the third VRF unit 704.

Figure 8:
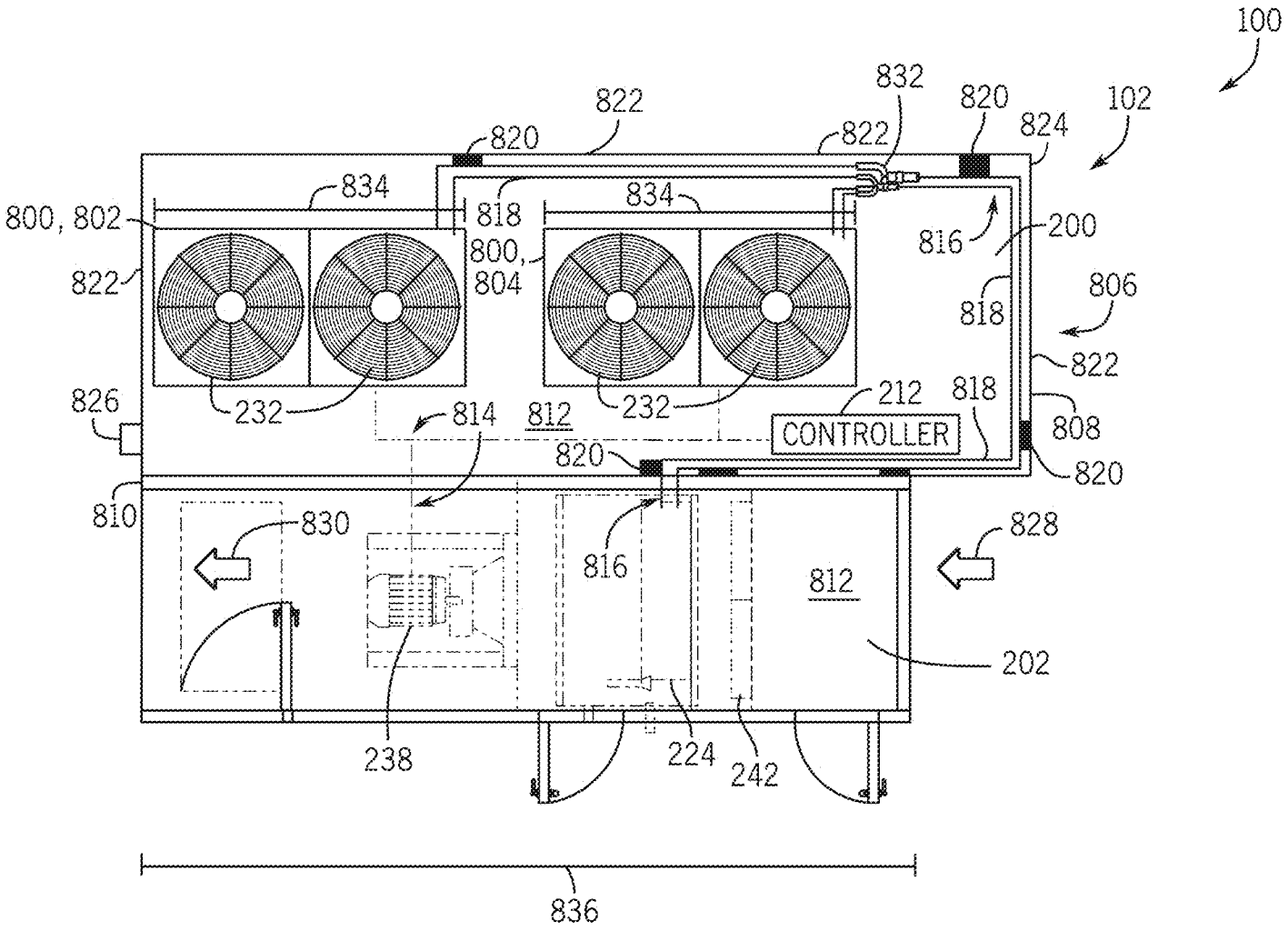
FIG. 8 is a schematic top view of an embodiment of an integrated HVAC unit having a VRF unit and an AHU, in accordance with an aspect of the present disclosure.

FIG. 8 is a schematic top view of an embodiment of the integrated HVAC unit 102 of the HVAC system 100 illustrating connections between, and an arrangement of, the components of the integrated HVAC unit 102. In particular, as shown in the illustrated embodiment, the integrated HVAC unit 102 may include the VRF section 200 and the AHU section 202 packaged together as a single unit. The VRF and AHU sections 200, 202 may be pre-packaged, pre-piped, and integrated with one another within a common enclosure 808 (e.g., common housing). Moreover, the integrated HVAC unit 102 may include a power connection 826 (e.g., centralized power connection, single power connection) configured to receive electrical power from a power source and to provide power to components of both the VRF and AHU sections 200, 202. The illustrated embodiment of the integrated HVAC unit 102 may be a 25 ton packaged integrated HVAC unit 102 unit or a 30 ton packaged integrated HVAC unit 102. As shown, the integrated HVAC unit 102 may include two VRF units 800, such as a first VRF unit 802 and a second VRF unit 804 within the VRF section 200. The VRF units 800 are fluidly coupled to the AHU heat exchanger 224. In the illustrated embodiment, each of the VRF units 800 (e.g., the first and second VRF units 802, 804) includes two fans 232 (e.g., condenser fans, heat exchanger fans). The fans 232 may operate to force an air flow through and across one or more VRF heat exchangers within each VRF unit 800.

Furthermore, as discussed herein, the integrated HVAC unit 102 may include the centralized controller 212 communicatively coupled to and configured to control and/or receive feedback from the components of the integrated HVAC unit 102, such as the first and second VRF units 802, 804 (e.g., respective compressors 222, reversing valves 220, VRF fans 232, ERV actuators 221, sensors 400 of each VRF unit 800), and the AHU blower 238, using the techniques discussed herein. Furthermore, the integrated HVAC unit 102 may be a single packaged unit 806 including the VRF section 200 and the AHU section 202, both within the common enclosure 808 and separated by a partition 810. The partition 810 may prevent air contained within the VRF section 200 from mixing with air contained within the AHU section 202. In particular, the VRF section 200 and the AHU section 202 may share a common platform 812 (e.g., common base, common frame, common support structure) of the integrated HVAC unit 102. The common platform 812 may support at least a portion of the weight of the integrated HVAC unit 102 and the components therein. In some embodiments, the integrated HVAC unit 102 may be a rooftop unit, and the common platform 812 may be positioned on a roof of a building containing the conditioned space 104.

The VRF section 200 may include the VRF units 800, the centralized controller 212, and a portion of electrical circuit connections 814 and/or refrigerant circuit connections 816 (e.g., portions of the refrigerant circuit 226, valves, conduits, etc.) of the integrated HVAC unit 102. The electrical circuit connections 814 may communicatively couple one or more components of the VRF section 200 and the AHU section 202 to enable transfer of data, feedback, control signals, and so forth therebetween. In particular, the VRF section 200 and the AHU section 202 may be controlled (e.g., synchronized, coordinated) by the centralized controller 212 to facilitate variable refrigerant flow within the vapor compression system 214 configured to efficiently satisfy a thermal load (e.g., heating and/or cooling load) of a conditioned space serviced by the integrated HVAC unit 102. Furthermore, the refrigerant circuit connections 816 may fluidly couple one or more components of the VRF section 200 and the AHU section 202 (e.g., the vapor compression system 214) to enable flow (e.g., variable flow) of refrigerant through the vapor compression system 214. As discussed herein, the refrigerant circuit connections 816 may include one or more separation tubes 832 configured to separate a single refrigerant flow into two refrigerant flows, or combine two refrigerant flows into a single refrigerant flow, depending on a refrigerant flow direction through the refrigerant circuit 226. Furthermore, in some embodiments, the refrigerant circuit connections 816 may include refrigerant tubes 818 (e.g., pipes, conduits, etc.) configured to fluidly couple components of the VRF section 200 (e.g., the VRF units 800, heat exchangers, valves 218, 220, compressors 222) and the components of the AHU section 202 (e.g., the AHU heat exchanger 224). The refrigerant tubes 818 may be supported at least partially by one or more support brackets 820 (e.g., retainers, mounts, clamps, etc.) disposed within the VRF section 200 and configured to support a tubing configuration of the refrigerant tubes 818. In some embodiments, the one or more support brackets 820 may be fastened (e.g., connected, secured, mechanically attached) to one or more outer walls 822 (e.g., inner side of the one or more outer walls 22) of the common enclosure 808. Additionally or alternatively, the one or more support brackets 820 may be fastened (e.g., connected, secured, mechanically attached) to the partition 810 (e.g., inner side of the partition 810) of the common enclosure 808. In some embodiments, one or more of the support brackets 820 may be secured to the common platform 812, a frame, and/or other suitable support structure of the integrated HVAC unit 102 (e.g., the common housing 808). The one or more support brackets 820 may be fastened using bolts and screws (e.g., mechanical fasteners), welding, and/or may be manufactured as a continuous piece (e.g., integrated component) with the respective structural component (e.g., outer walls 822, partition 810, common platform 812) of the VRF section 200 of the integrated HVAC unit 102. In the illustrated embodiment, the refrigerant tubes 818 are arranged to extend generally along a portion of an outer perimeter 824 of the VRF section 200 (e.g., the common housing 808) and are fastened via the support brackets 820 to the outer walls 822 and the partition 810. As illustrated in FIG. 8, a portion of the outer perimeter 824 of the integrated HVAC unit 102 is defined by the outer walls 822 of the VRF section 200. Additionally, one or more of the refrigerant tubes 818 extend through the partition 810 to enable fluid coupling of components within the VRF section 200 and the AHU section 202. In this way, the configuration and/or arrangement of the refrigerant tubes 818 (e.g., refrigerant circuit connections 816, refrigerant circuit 226) may be secured and retained in a desired manner, and as a result the integrated HVAC unit 102 may be manufactured (e.g., pre-packaged), transported, and installed in a desired location as a single unit with greater efficiency and simplicity.

The AHU section 202 may be disposed adjacent to the VRF section 200, such that the partition 810 may be at least a portion of a wall of the VRF section 200 and a portion of a wall of the AHU section 202. Furthermore, the AHU section 202 may include a portion of the electrical circuit connections 814 and/or the refrigerant circuit connections 816 (e.g., refrigerant circuit 226). As discussed herein, the AHU section 202 may include the AHU heat exchanger 224, one or more AHU blowers 238, and/or one or more filters 242. The AHU section 202 may receive an air flow 828 (e.g., outside air, return air, a mix of outside air and return air) directed through and across the AHU heat exchanger 224. In addition the AHU section 202 may discharge (e.g., supply, provide) a supply air flow 830 towards the conditioned space 104.

Further, in the illustrated embodiment, the VRF section 200 and the AHU section 202 are arranged in a side-by-side (e.g., side-by-side mounting arrangement) with one another with the partition 810 therebetween, such that the VRF section 200 and the AHU section 202 each extend along the partition 810 and along a length 836 of the AHU section 202. That is, the length 836 of the AHU section 202 abuts the VRF section 200 (e.g., via the partition 810) along the length 836 of the AHU section 202. The VRF units 800 of the illustrated embodiment are arranged in an end-to-end arrangement, such that the VRF units 800 are aligned along a direction of the length 836 of the AHU section 202 and/or a direction of a length of the VRF section 200. In this way, the integrated HVAC unit 102 is packaged in the common housing 808 in a more compact configuration (e.g., reduced physical footprint), which may improve ease of transportation and installation of the integrated HVAC unit 102.

Figure 9:
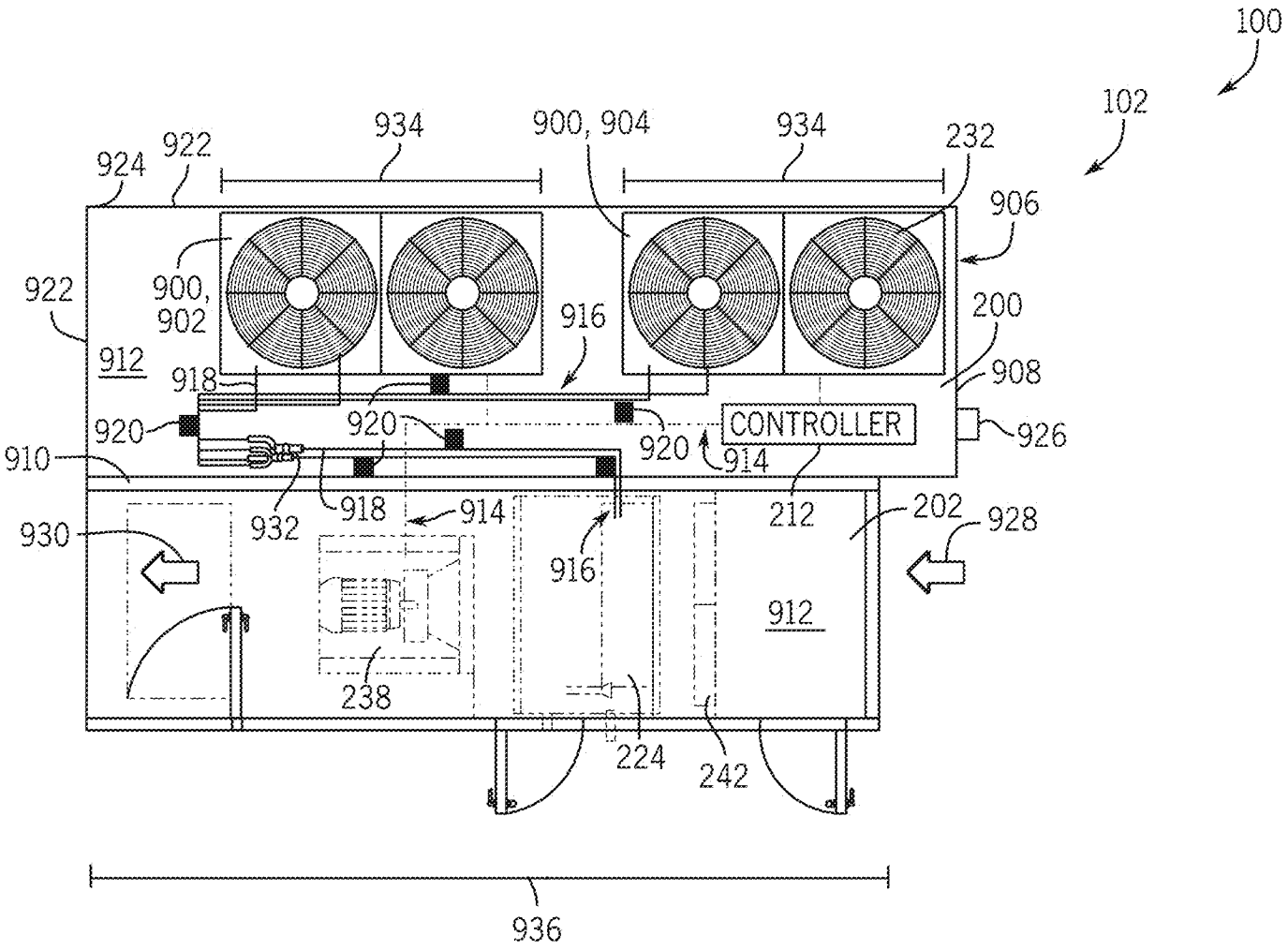
FIG. 9 is a schematic top view of an embodiment of an integrated HVAC unit having a VRF unit and an AHU, in accordance with an aspect of the present disclosure.

FIG. 9 is a schematic top view of an embodiment of the integrated HVAC unit 102 of the HVAC system 100 illustrating connections between, and an arrangement of, components of the integrated HVAC unit 102. The integrated HVAC unit 102 includes elements similar to those described above with reference to FIG. 8. For example, the illustrated integrated HVAC unit 102 includes the VRF section 200 and the AHU section 202 similarly illustrated in FIG. 8 and described above. The integrated HVAC unit 102 is pre-packaged and pre-piped, such that the VRF section 200 and the AHU section 202 are integrated with one another within a common enclosure 908 (e.g., common housing). Moreover, the integrated HVAC unit 102 includes a power connection 926 (e.g., centralized power connection, single power connection) configured to receive electrical power from a power source and to provide power to components of both the VRF and AHU sections 200, 202. The illustrated embodiment of the integrated HVAC unit 102 may be a 30 ton packaged unit or another unit of desired capacity. The integrated HVAC unit 102 includes two VRF units 900, such as a first VRF unit 902 and a second VRF unit 904, which are fluidly coupled to the AHU heat exchanger 224 of the AHU section 202. In the illustrated embodiment, each of the VRF units 900 (e.g., the first and second VRF units 902, 904) includes two fans 232 (e.g., heat exchanger fans, condenser fans). The fans 232 may force an air flow through and across the one or more VRF heat exchangers within each VRF unit 900. Furthermore, as discussed herein, the integrated HVAC unit 102 may include the centralized controller 212 communicatively coupled to and configured to control and/or receive feedback from one or more components of the integrated HVAC unit 102, such as the first and second VRF units 902, 904 (e.g., respective compressors 222, reversing valves 220, ERV actuators 221, VRF fans 232, sensors 400 of each VRF unit 900), and the AHU blower 238, using the techniques discussed herein. Furthermore, the integrated HVAC unit 102 may be a single packaged unit 906 including the VRF section 200 and the AHU section 202, both within the common enclosure 908 and separated by a partition 910. The partition 910 may prevent air contained within the VRF section 200 from mixing with air contained within the AHU section 202. In particular, the VRF section 200 and the AHU section 202 may share a common platform 912 (e.g., common base, common frame, common support structure) of the integrated HVAC unit 102. The common platform 912 may support at least a portion of the weight of the integrated HVAC unit 102, including the one or more components of the integrated HVAC unit 102. In some embodiments, the integrated HVAC unit 102 may be a rooftop unit, and the common platform 912 may be positioned on a roof of a building containing the conditioned space 104.

The VRF section 200 may include the VRF units 900, the centralized controller 212, and a portion of electrical circuit connections 914 and/or refrigerant circuit connections 916 (e.g., refrigerant circuit 226) of the vapor compression system 214. The electrical circuit connections 914 may communicatively couple one or more components of the VRF section 200 and the AHU section 202. In particular, the VRF section 200 and the AHU section 202 may be controlled (e.g., synchronized, coordinated) by the centralized controller 212 to facilitate variable refrigerant flow within the vapor compression system 214 configured to efficiently satisfy a thermal load (e.g., heating and/or cooling load). Furthermore, the refrigerant circuit connections 916 may fluidly couple one or more components of the VRF section 200 and the AHU section 202 (e.g., the vapor compression system 214). As discussed herein, the refrigerant circuit connections 816 may include one or more separation tubes 932 configured to separate a single refrigerant flow into two refrigerant flows, or combine two refrigerant flows into a single refrigerant flow, depending on a refrigerant flow direction through the refrigerant circuit 226.

Furthermore, in some embodiments, the refrigerant circuit connections 916 may include refrigerant tubes 918 (e.g., pipes, conduits, etc.) configured to fluidly couple components of the VRF section 200 (e.g., VRF units 900) and components of the AHU section 202 (e.g., AHU heat exchanger 224). The refrigerant tubes 918 may be supported at least partially by one or more support brackets 920 disposed within the VRF section 200 and/or the AHU section 202 and configured to support a tubing configuration of the refrigerant tubes 918. In some embodiments, the one or more support brackets 920 may be fastened (e.g., connected) to one or more outer walls 922 of the common enclosure 908. Additionally or alternatively, the one or more support brackets 920 may be fastened (e.g., connected) to the partition 910 of the common enclosure 908, to the common platform 912, to a frame of the integrated HVAC unit 102, to another component of the common enclosure 908, and so forth. In the illustrated embodiment, the refrigerant tubes 918 are arranged in a tubing configuration traversing a space within the VRF section 200 between the VRF units 900 and the partition 910. In the illustrated embodiment, one or more of the support brackets 920 may be fastened to and extend from the common platform 912 to support the refrigerant tubes 918. Additionally or alternatively, a portion of the refrigerant tubes 918 may extend along at least a portion of an outer perimeter 924 of the VRF section 200 and may be fastened via the support brackets 920 to the outer walls 922 and the partition 910. As illustrated in FIG. 9, a portion of the outer perimeter 924 of the integrated HVAC unit 102 is defined by the outer walls 922 of the VRF section 200. The one or more support brackets 920 may be fastened using bolts and screws (e.g., mechanical fasteners), welding, and/or may be manufactured as a continuous piece with the respective wall (e.g., outer walls 922, partition 910) of the VRF section 200 of the integrated HVAC unit 102. The refrigerant tubes 918 also extend through the partition 910 to fluidly couple respective components of the VRF section 200 and the AHU section 202 with one another.

Similar to FIG. 8, the AHU section 202 of FIG. 9 may be disposed adjacent to the VRF section 200, such that the partition 910 may be at least a portion of a wall of the VRF section 200 and a portion of a wall of the AHU section 202. Furthermore, the AHU section 202 may include a portion of the electrical circuit connections 914 and/or the refrigerant circuit connections 916 (e.g., refrigerant circuit 226). As discussed herein, the AHU section 202 may include the AHU heat exchanger 224, one or more AHU blowers 238, and/or one or more filters 242. The AHU section 202 may receive an air flow 928 (e.g., outside air, return air, mix of outside air and return air) directed through and across the AHU heat exchanger 224. In addition, the AHU section 202 may expel (e.g., supply, provide, discharge) a supply air flow 930 towards the conditioned space 104.

Further, in the illustrated embodiment, the VRF section 200 and the AHU section 202 are arranged in a side-by-side with one another (e.g., side-by-side mounting arrangement) with the partition 910 therebetween, such that the VRF section 200 and the AHU section 202 each extend along the partition 910 and along a length 936 of the AHU section 202. That is, the length 936 of the AHU section 202 abuts the VRF section 200 (e.g., via the partition 910) along the length 936 of the AHU section 202. The VRF units 900 of the illustrated embodiment are arranged in an end-to-end arrangement, such that the VRF units 900 are aligned along a direction of the length 936 of the AHU section 202 and/or a direction of a length of the VRF section 200. In this way, the integrated HVAC unit 102 is packaged in the common housing 908 in a more compact configuration (e.g., reduced physical footprint), which may improve ease of transportation and installation of the integrated HVAC unit 102.

Figure 10:
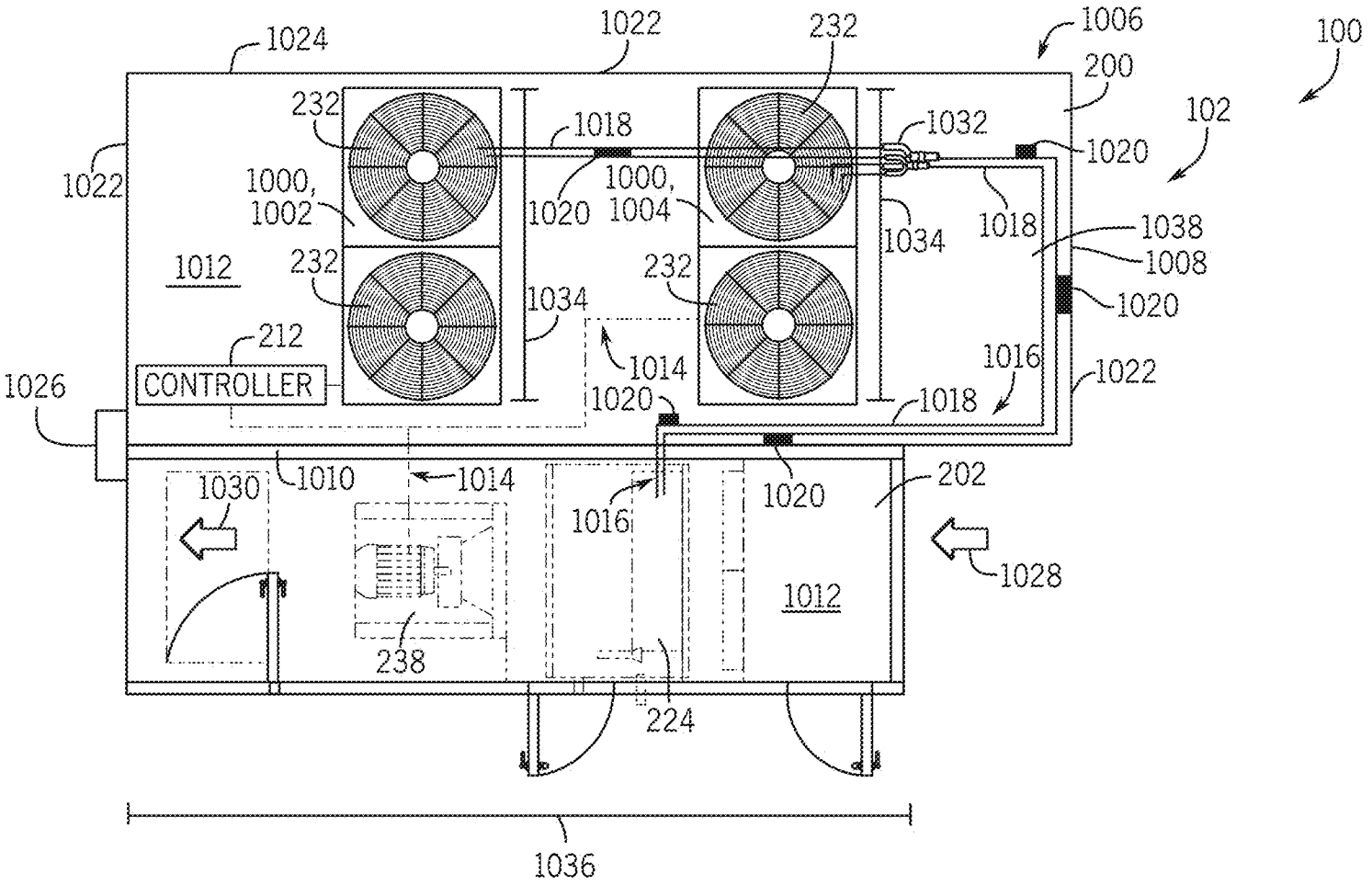
FIG. 10 is a schematic top view of an embodiment of an integrated HVAC unit having a VRF unit and an AHU, in accordance with an aspect of the present disclosure.

FIG. 10 is a schematic top view of an embodiment of the integrated HVAC unit 102 of the HVAC system 100 illustrating connections between, and an arrangement of, the components of the integrated HVAC unit 102. In particular, as shown in the illustrated embodiment, the integrated HVAC unit 102 includes the VRF section 200 and the AHU section 202, as similarly illustrated in FIGS. 8 and 9. The integrated HVAC unit 102 is pre-packaged and pre-piped, such that the VRF section 200 and the AHU section 202 are integrated with one another within a common enclosure 1008 (e.g., common housing). Moreover, the integrated HVAC unit 102 may include a power connection 1026 (e.g., centralized power connection, single power connection) configured to receive electrical power from a power source and to provide power to components of both the VRF and AHU sections 200, 202. In this way, installation of the integrated HVAC unit 102 may be simplified. The illustrated integrated HVAC unit 102 may be a 30 ton packaged integrated HVAC unit 102 or may have another suitable capacity. The integrated HVAC unit 102 may include two VRF units 1000, such as a first VRF unit 1002 and a second VRF unit 1004, fluidly coupled to the AHU heat exchanger 224 in the AHU section 202. In the illustrated embodiment, each of the VRF units 1000 (e.g., the first and second VRF units 1002, 1004) includes two fans 232 (e.g., condenser fans, heat exchanger fans), but other embodiments may include another suitable number of fans 232 in each VRF unit 1000. The fans 232 are configured to force an air flow through and across the VRF heat exchangers within each VRF unit 1000. Furthermore, as discussed herein, the illustrated integrated HVAC unit 102 may include the centralized controller 212 communicatively coupled to and configured to control and/or receive feedback from the components of the integrated HVAC unit 102, such as the first and second VRF units 1002, 1004 (e.g., respective compressors 222, reversing valves 220, ERV actuators 221, VRF fans 232, sensors 400), and the AHU blower 238, using the techniques discussed herein. Furthermore, the integrated HVAC unit 102 may be a single packaged unit 1006 including the VRF section 200 and the AHU section 202, both within the common enclosure 1008 and separated by a partition 1010. The partition 1010 may prevent air contained within the VRF section 200 from mixing with air contained within the AHU section 202. In particular, the VRF section 200 and the AHU section 202 may share a common platform 1012 (e.g., common base, common frame) of the integrated HVAC unit 102. The common platform 1012 may support at least a portion of the weight of the integrated HVAC unit 102, including the one or more components of the integrated HVAC unit 102. In some embodiments, the integrated HVAC unit 102 may be a rooftop unit, and the common platform 1012 may be positioned on a roof of a building containing the conditioned space 104.

The VRF section 200 may include the VRF units 1000, the centralized controller 212, and a portion of electrical circuit connections 1014 and/or refrigerant circuit connections 1016 (e.g., refrigerant circuit 226). In the illustrated embodiment, the VRF units 1000 are arranged such that a length 1034 of each VRF unit 1000 extends cross-wise (e.g., substantially perpendicular) to a length 1036 of the AHU section 202. The lengths 1034 of the VRF units 1000 also extend cross-wise (e.g., substantially perpendicular) to the partition 1010. The electrical circuit connections 1014 may communicatively couple one or more components of the VRF section 200 and the AHU section 202. In particular, the VRF section 200 and the AHU section 202 may be controlled (e.g., synchronized, coordinated) by the centralized controller 212 to facilitate variable refrigerant flow within the vapor compression system 214 configured to efficiently satisfy a thermal load (e.g., heating and/or cooling load) of the conditioned space 104. Furthermore, the refrigerant circuit connections 1016 may fluidly couple one or more components of the VRF section 200 and the AHU section 202 (e.g., the vapor compression system 214). As discussed herein, the refrigerant circuit connections 1016 may include one or more separation tubes 1032 configured to separate a single refrigerant flow into two refrigerant flows or combine two refrigerant flows into a single refrigerant flow, depending on a refrigerant flow direction through the refrigerant circuit 224.

Furthermore, in some embodiments, the refrigerant circuit connections 1016 may include refrigerant tubes 1018 (e.g., pipes, conduits, etc.) configured to fluidly couple components of the VRF section 200 (e.g., the VRF units 1000) and components of the AHU section 202 (e.g., the AHU heat exchanger 224). The refrigerant tubes 1018 may be supported at least partially by one or more support brackets 1020 disposed within the VRF section 200 and/or the AHU section 202 and configured to support a tubing configuration of the refrigerant tubes 1018. In some embodiments, the one or more support brackets 1020 may be fastened (e.g., connected) to one or more outer walls 1022 of the common enclosure 1008. Additionally or alternatively, the one or more support brackets 1020 may be fastened (e.g., connected) to the partition 1010 of the common enclosure 1008, to the common platform 1012, to another component of the common enclosure 1008, and so forth. In the illustrated embodiment, the refrigerant tubes 1018 are arranged in a tubing configuration traversing at least a portion of the second VRF unit 1004. In some embodiments, one or more of the support brackets 1020 may be fastened to and extend from (e.g., suspend from) a ceiling 1038 of the common enclosure 1008 and/or from the common platform 1012 to support the refrigerant tubes 1018. Additionally or alternatively, a portion of the refrigerant tubes 1018 may extend along at least a portion of an outer perimeter 1024 of the VRF section 200 and may be fastened via the support brackets 1020 to the outer walls 1022 and/or the partition 1010. As illustrated in FIG. 10, a portion of the outer perimeter 1024 of the integrated HVAC unit 102 is defined by the outer walls 1022 of the VRF section 200. The one or more support brackets 1020 may be fastened using bolts and screws (e.g., mechanical fasteners), welding, or may be manufactured as a continuous piece with a respective wall (e.g., outer walls 1022, partition 1010) of the VRF section 200 and/or AHU section 202 of the integrated HVAC unit 102. The refrigerant tubes 1018 also extend through the partition 1010 to fluidly couple respective components of the VRF section 200 and the AHU section 202 with one another.

Similar to FIGS. 8 and 9, the AHU section 202 of FIG. 10 may be disposed adjacent to the VRF section 200, such that the partition 1010 may be at least a portion of a wall of the VRF section 200 and a portion of a wall of the AHU section 202. Furthermore, the AHU section 202 may include a portion of the electrical circuit connections 1014 and/or the refrigerant circuit connections 1016 (e.g., refrigerant circuit 226). As discussed herein, the AHU section 202 may include the AHU heat exchanger 224, one or more AHU blowers 238, and/or one or more filters 242. The AHU section 202 may receive an air flow 1028 (e.g., outside air, return air, some mix of outside air and return air) directed through and across the AHU heat exchanger 224. In addition the AHU section 202 may expel (e.g., supply, provide, discharge) a supply air flow 1030 towards the conditioned space 104.

Further, in the illustrated embodiment, the VRF section 200 and the AHU section 202 are arranged in a side-by-side with one another (e.g., side-by-side mounting arrangement) with the partition 1010 therebetween, such that the VRF section 200 and the AHU section 202 each extend along the partition 1010 and along the length 1036 (e.g., longitudinal axis) of the AHU section 202. That is, the length 1036 of the AHU section 202 abuts the VRF section 200 (e.g., via the partition 1010) along the length 1036 of the AHU section 202. As discussed above, the VRF units 1000 of the illustrated embodiment are arranged in a side-by-side arrangement, such that the VRF units 1000 each extend along a direction cross-wise (e.g., perpendicular) to the length 1036 of the AHU section 202 and/or a direction cross-wise (e.g., perpendicular) to a length (e.g., longitudinal axis) of the VRF section 200. In this manner, the integrated HVAC unit 102 may be packaged in the common housing 1008 in a more compact configuration (e.g., reduced physical footprint), which may improve ease of transportation and installation of the integrated HVAC unit 102.

Figure 11:
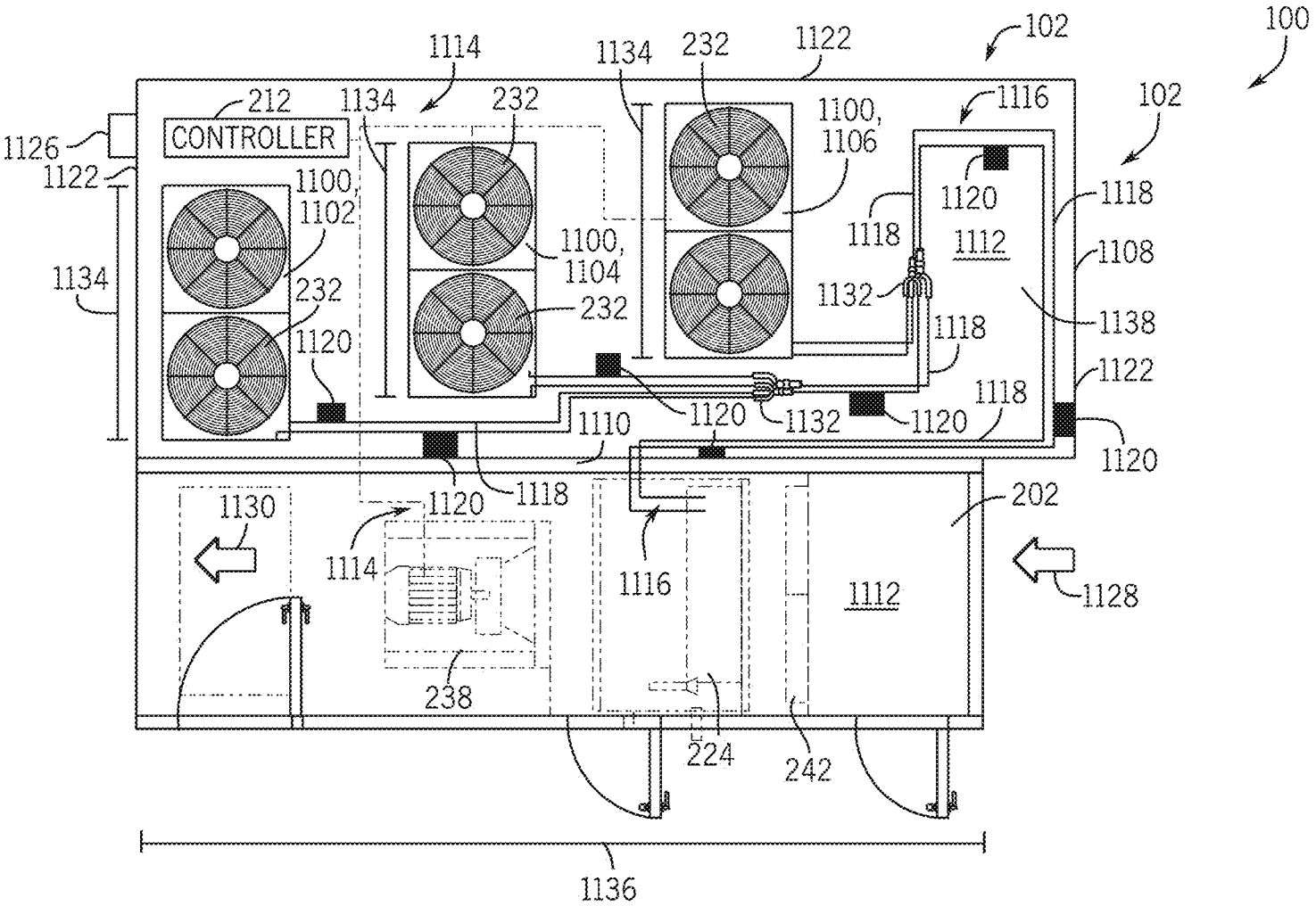
FIG. 11 is a schematic top view of an embodiment of an integrated HVAC unit having a VRF unit and an AHU, in accordance with an aspect of the present disclosure.

FIG. 11 is a schematic top view of an embodiment of the integrated HVAC unit 102 of the HVAC system 100 illustrating connections between, and an arrangement of, the components of the integrated HVAC unit 102. As similarly discussed above, the integrated HVAC unit 102 may include the VRF section 200 and the AHU section 202 as similarly illustrated in FIGS. 8, 9, and 10. The integrated HVAC unit 102 is pre-packaged and pre-piped, such that the VRF section 200 and the AHU section 202 are integrated with one another within a common enclosure 1108 (e.g., common housing). Thus, the integrated HVAC unit 102 may be more efficiently transported and/or installed in an operating location. Moreover, the integrated HVAC unit 102 may include a power connection 1126 (e.g., centralized power connection, single power connection) configured to receive electrical power from a power source and to provide power to components of both the VRF and AHU sections 200, 202. As a result, installation of the integrated HVAC unit 102 may be simplified.

The illustrated integrated HVAC unit 102 may be a 36 ton packaged integrated HVAC unit 102. The integrated HVAC unit 102 may include three VRF units 1100, such as a first VRF unit 1102, a second VRF unit 1104, and a third VRF unit 1106, fluidly coupled to the AHU heat exchanger 224 in the AHU section 202. In the illustrated embodiment, each of the VRF units 1000 (e.g., first, second, third VRF units 1102, 1104, 1106) includes two fans 232 (e.g., condenser fans, heat exchanger fans). The fans 232 are configured to force an air flow through and across the one or more VRF heat exchangers within each VRF unit 1000. Furthermore, as discussed herein, the integrated HVAC unit 102 may include the centralized controller 212 communicatively coupled to and configured to control and/or receive feedback from components of the integrated HVAC unit 102, such as the first, second, third VRF units 1102, 1104, 1106 (e.g., respective compressors 222, reversing valves 220, ERV actuators 221, VRF fans 232, sensors 400 of each VRF unit 1100), and the AHU blower 238, using the techniques discussed herein. Furthermore, the integrated HVAC unit 102 may be a single packaged unit 1105 including the VRF section 200 and the AHU section 202, both within the common enclosure 1108 and separated by a partition 1110. The partition 1110 may prevent air contained within the VRF section 200 from mixing with air contained within the AHU section 202. In particular, the VRF section 200 and the AHU section 202 may share a common platform 1112 (e.g., common base) of the integrated HVAC unit 102. The common platform 1112 may support at least a portion of the weight of the integrated HVAC unit 102, including one or more components of the integrated HVAC unit 102. In some embodiments, the integrated HVAC unit 102 may be a rooftop unit, and the common platform 1112 may be positioned on a roof of a building containing the conditioned space 104.

The VRF section 200 may include the VRF units 1100, the centralized controller 212, and a portion of electrical circuit connections 1114 and/or refrigerant circuit connections 1116

(e.g., refrigerant circuit 226). In the illustrated embodiment, the VRF units 1100 are arranged within the VRF section 200 such that a respective length 1134 (e.g., longitudinal axis) of each VRF unit 1100 extends cross-wise (e.g., substantially perpendicular to) a length 1136 (e.g., longitudinal axis) of the AHU section 202. Thus, the VRF units 1100 are in a side-by-side arrangement with one another, similar to the side-by-side arrangement of the VRF section 200 and the AHU section 202. Moreover, the electrical circuit connections 1114 may communicatively couple one or more components of the VRF section 200 and the AHU section 202. In particular, the VRF section 200 and the AHU section 202 may be controlled (e.g., synchronized, coordinated) by the centralized controller 212 to facilitate variable refrigerant flow within the vapor compression system 214 configured to efficiently satisfy a thermal load (e.g., heating and/or cooling load). Furthermore, the refrigerant circuit connections 1116 may fluidly couple one or more components of the VRF section 200 and the AHU section 202 (e.g., the vapor compression system 214). As discussed herein, the refrigerant circuit connections 1116 may include one or more separation tubes 1132 configured to separate a single refrigerant flow into two refrigerant flows or combine two refrigerant flows into a single refrigerant flow, depending on a refrigerant flow direction through the refrigerant circuit 226.

Furthermore, in some embodiments, the refrigerant circuit connections 1116 may include refrigerant tubes 1118 (e.g., pipes, conduits, etc.) configured to fluidly couple components of the VRF section 200 (e.g., VRF units 1100) and components of the AHU section 202 (e.g., AHU heat exchanger 224). The refrigerant tubes 1118 may be supported at least partially by one or more support brackets 1120 disposed within the VRF section 200 and/or AHU section 202 and be configured to support a tubing configuration of the refrigerant tubes 1118. Indeed, the support brackets 1120 may enable securement of the refrigerant tubes 1118 during transportation of the integrated HVAC unit 102. In some embodiments, the one or more support brackets 1120 may be fastened (e.g., connected) to one or more outer walls 1122 of the common enclosure 1108. Additionally or alternatively, the one or more support brackets 1120 may be fastened (e.g., connected) to the partition 1110 of the common enclosure 1108, to the common platform 1112, to another structural component of the common enclosure 1108, and so forth. In the illustrated embodiment, the refrigerant tubes 1118 are arranged in a tubing configuration traversing a portion of a space within the VRF section 200 between the VRF units 1100 and the AHU section 202. Accordingly, one or more of the support brackets 1120 may be fastened to and extend from (e.g., suspend from) a ceiling 1138 of the common enclosure 1108 and/or from the common platform 1112 to support the refrigerant tubes 1118. Additionally or alternatively, a portion of the refrigerant tubes 1118 may extend along at least a portion of an outer perimeter 1124 of the VRF section 200 and may be fastened via the support brackets 1120 to the outer walls 1122 and the partition 1110. As illustrated in FIG. 11, a portion of the outer perimeter 1124 of the integrated HVAC unit 102 is defined by the outer walls 1122 of the VRF section 200. The one or more support brackets 1120 may be fastened using bolts and screws, welding, or may be manufactured as a continuous piece with the respective wall (e.g., outer walls 1122, partition 1110) of the VRF section 200 of the integrated HVAC unit 102. The refrigerant tubes 1118 also extend through the partition 1110 to fluidly couple respective components of the VRF section 200 and the AHU section 202 with one another.

Similar to FIGS. 8, 9, and 10, the AHU section 202 of FIG. 11 may be disposed adjacent to the VRF section 200, such that the partition 1110 may be at least a portion of a wall of the VRF section 200 and a portion of a wall of the AHU section 202. Furthermore, the AHU section 202 may include a portion of the electrical circuit connections 1114 and/or the refrigerant circuit connections 1116 (e.g., refrigerant circuit 226). As discussed herein, the AHU section 202 may include the AHU heat exchanger 224, one or more AHU blowers 238, and/or one or more filters 242. The AHU section 202 may receive an air flow 1128 (e.g., outside air, return air, some mix of outside air and return air) directed through and across the AHU heat exchanger 224. In addition the AHU section 202 may expel (e.g., supply, provide, discharge) a supply air flow 1130 towards the conditioned space 104.

Further, in the illustrated embodiment, the VRF section 200 and the AHU section 202 are arranged in a side-by-side with one another (e.g., side-by-side mounting arrangement) with the partition 1110 therebetween, such that the VRF section 200 and the AHU section 202 each extend along the partition 1110 and along the length 1136 (e.g., longitudinal axis) of the AHU section 202. That is, the length 1136 of the AHU section 202 abuts the VRF section 200 (e.g., via the partition 1110) along the length 1136 of the AHU section 202. As discussed above, the VRF units 1100 of the illustrated embodiment are arranged in a side-by-side arrangement, such that the VRF units 1100 each extend along a direction cross-wise (e.g., perpendicular) to the length 1136 of the AHU section 202 and/or a direction cross-wise (e.g., perpendicular) to a length (e.g., longitudinal axis) of the VRF section 200. In this manner, the integrated HVAC unit 102 may be packaged in the common housing 1008 in a more compact configuration (e.g., reduced physical footprint), which may improve ease of transportation and installation of the integrated HVAC unit 102. It should be understood that while FIGS. 8-11 illustrate the VRF section 200 (e.g., the respective VRF units contained within) and the AHU section 202 arranged in a side-by-side arrangement, in some embodiments, the VRF section 200 (e.g., the respective VRF units contained within) may be mounted on top of the AHU section 202 in a top mounted arrangement, with respect to a vertical axis substantially perpendicular to a direction of the airflow within the AHU section 202. Furthermore, a partition may extend between the VRF section 200 and the AHU section, such that the VRF section 200 and the AHU section 202 each may extend along the partition and along the length of the AHU section 202. In particular, the partition may include at least a portion of a base panel of the VRF section 200 and a ceiling panel of the AHU section 202. In this manner, the integrated HVAC unit 102 may be packaged in a more compact configuration (e.g., reduced physical footprint), which may improve ease of transportation and installation of the integrated HVAC unit 102.

Figure 12:
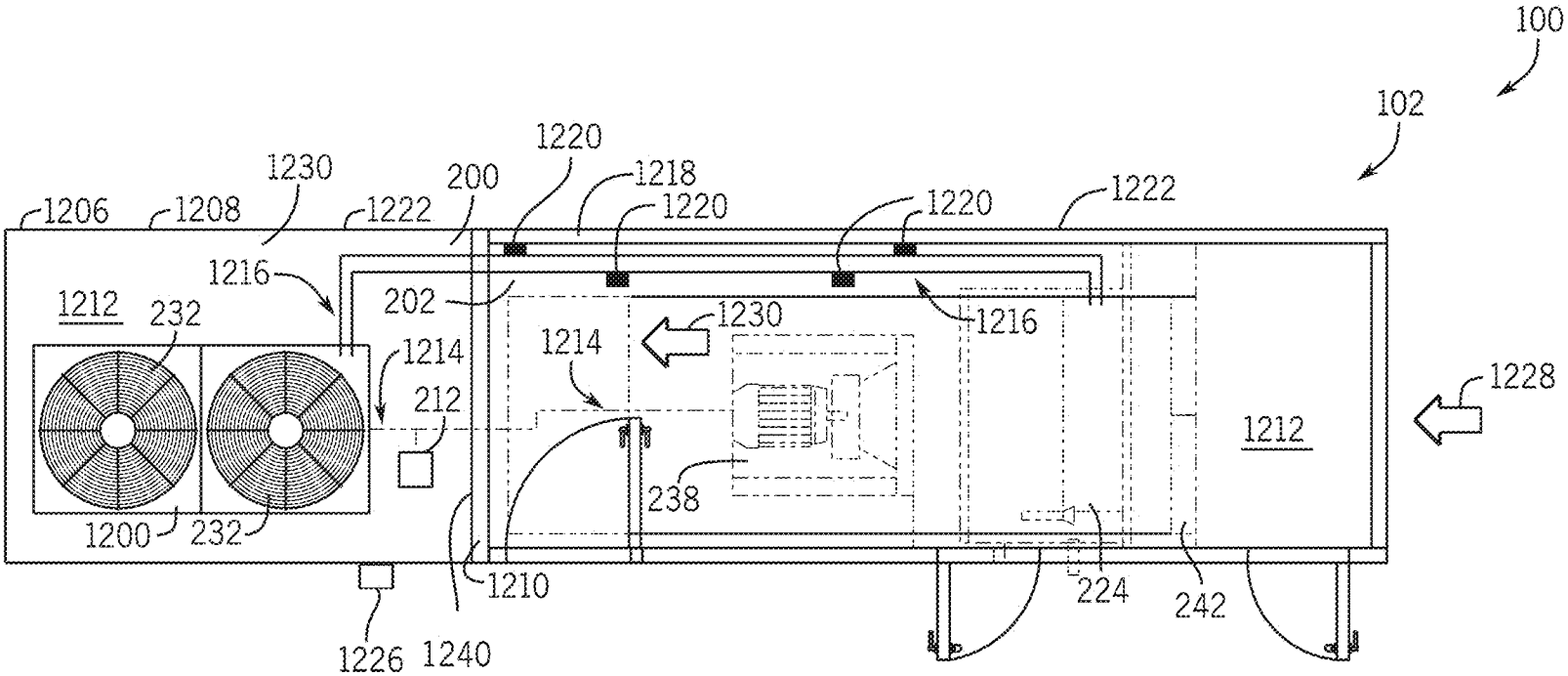
FIG. 12 is a schematic top view of an embodiment of an integrated HVAC unit having a VRF unit and an AHU, in accordance with an aspect of the present disclosure.

FIG. 12 is a schematic top view of an embodiment of the integrated HVAC unit 102 of the HVAC system 100 illustrating connections between, and an arrangement of, the components of the integrated HVAC unit 102. As shown, the integrated HVAC unit 102 includes the VRF section 200 and the AHU section 202. The integrated HVAC unit 102 is pre-packaged and pre-piped, such that the VRF section 200 and AHU section 202 are integrated with one another within a common enclosure 1208 (e.g., common housing). Moreover, the integrated HVAC unit 102 includes a power connection 1226 (e.g., centralized power connection, single power connection) configured to receive electrical power from a power source and to provide power to components of both the VRF and AHU sections 200, 202. The illustrated integrated HVAC unit 102 includes a single VRF unit 1200 fluidly coupled to the AHU heat exchanger 224 in the AHU section 202. The single VRF unit 1200 includes two fans 232 (e.g., condenser fans, heat exchanger fans). The fans 232 are configured to force an air flow through and across one or more VRF heat exchangers within the VRF unit 1200. Furthermore, as discussed herein, the illustrated integrated HVAC unit 102 may include the centralized controller 212 communicatively coupled to and configured to control and/or receive feedback from components of the integrated HVAC unit 102, such as the VRF unit 1200 (e.g., compressors 222, reversing valves 220, ERV actuators 221, VRF fans 232, sensors 400), and the AHU blower 238, using the techniques discussed herein. Furthermore, the integrated HVAC unit 102 may be a single packaged unit 1206 include the VRF section 200 and the AHU section 202, both within the common enclosure 1208 and separated by a partition 1210. In particular, the VRF section 200 and the AHU section 202 may share a common platform 1212 (e.g., common base) of the integrated HVAC unit 102. The common platform 1212 may support at least a portion of the weight of the integrated HVAC unit 102, including one or more components of the integrated HVAC unit 102. In some embodiments, the integrated HVAC unit 102 may be a rooftop unit, and the common platform 1212 may be positioned on a roof of a building containing the conditioned space 104.

The VRF section 200 may include the VRF unit 1200, the centralized controller 212, and a portion of electrical circuit connections 1214 and/or refrigerant circuit connections 1216 (e.g., refrigerant circuit 226). In the illustrated embodiment, the VRF section 200 and the AHU section 202 are packaged in an end-to-end arrangement, as opposed to an adjacent, side-by-side arrangement illustrated in FIGS. 8-11. That is, respective lengths of the VRF section 200 and the AHU section 202 are aligned with one another along a length or longitudinal axis of the integrated HVAC unit 102. The single VRF unit 1200 is also arranged to extend along the respective lengths of the VRF section 200 and the integrated HVAC unit 102. Thus, the partition 1210 extends between the VRF section 200 and the AHU section 202 in a direction generally cross-wise (e.g., perpendicular) to the lengths of the VRF section 200, AHU section 202, and integrated HVAC unit 102.

Moreover, the electrical circuit connections 1214 may communicatively couple one or more components of the VRF section 200 and the AHU section 202. In particular, the VRF section 200 and the AHU section 202 may be controlled (e.g., synchronized, coordinated) by the centralized controller 212 to facilitate variable refrigerant flow within the vapor compression system 214 configured to efficiently satisfy a thermal load (e.g., heating and/or cooling load) of the conditioned space 104. Furthermore, the refrigerant circuit connections 1216 may fluidly couple one or more components of the VRF section 200 and the AHU section 202 (e.g., the vapor compression system 214). In some embodiments, the refrigerant circuit connections 1216 may include refrigerant tubes 1218 (e.g., pipes, conduits, etc.) configured to fluidly couple components of the VRF section 200 (e.g., VRF unit 1200) and components of the AHU section 202 (e.g., AHU heat exchanger 224). The refrigerant tubes 1218 may be supported at least partially by one or more support brackets 1220 disposed within the VRF section 200 and/or the AHU section 202 and be configured to support a tubing configuration of the refrigerant tubes 1218 and secure the refrigerant tubes 1218 in a desired manner during transportation and installation of the integrated HVAC unit 102. In some embodiments, the one or more support brackets 1220 may be fastened (e.g., connected) to one or more outer walls 1222 of the common enclosure 1208. Additionally or alternatively, the one or more support brackets 1220 may be fastened (e.g., connected) to the partition 1210 of the common enclosure 1208, may be fastened to and extend from (e.g., suspend from) a ceiling 1238 of the common enclosure 1208, may be fastened to and extend from the common platform 1212, may be fastened to and extend from another component of the common enclosure 1208, or any combination thereof, to support the refrigerant tubes 1218. The one or more support brackets 1220 may be fastened using bolts and screws, welding, or may be manufactured as a continuous piece with the respective wall, ceiling, and/or platform (e.g., outer walls 1222, partition 1210, ceiling 1238, common platform 1212) of the VRF section 200 of the integrated HVAC unit 102.

The AHU section 202 of FIG. 12 may be disposed at an end 1240 (e.g., longitudinal end) of the VRF section 200 (e.g., end-to-end mounting arrangement), such that the partition 1210 may be both a wall of the VRF section 200 and a wall of the AHU section 202. Furthermore, the AHU section 202 may include a portion of the electrical circuit connections 1214 and/or the refrigerant circuit connections 1216 (e.g., refrigerant circuit 226). The refrigerant tubes 1218 also extend through the partition 1210, as similarly described above, to fluidly couple respective components of the VRF section 200 and AHU section 202. As discussed herein, the AHU section 202 may include the AHU heat exchanger 224, one or more AHU blowers 238, and/or one or more filters 242. The AHU section 202 may receive an air flow 1228 (e.g., outside air, return air, some mix of outside air and return air) directed through and across the AHU heat exchanger 224. In addition the AHU section 202 may expel (e.g., supply, provide, discharge) a supply air flow 1230 towards the conditioned space 104.

As discussed in detail above, present embodiments are directed to an integrated HVAC unit having a VRF unit and an AHU integrated with one another in a single packaged (e.g., pre-packaged) unit. The integrated HVAC unit includes a vapor compression system (e.g., refrigerant circuit) extending through the VRF unit and the AHU that is configured to operate in a heating mode and a cooling mode. Thus, the refrigerant circuit may operate to provide both heating and cooling to a conditioned space (e.g., without a separate heating system). The VRF unit is also configured to enable operation of the integrated HVAC unit utilizing variable refrigerant flow techniques. Thus, present embodiments enable more efficient operation to condition a space. Further, the techniques described herein enable more efficient installation of the integrated HVAC unit. For example, the pre-packaged and pre-piped configuration of the integrated HVAC unit enables incorporation of a variable refrigerant flow system without the use of extensive refrigerant conduits or ductwork extending through a building or other conditioned space. The packaged, integrated HVAC unit may also be more efficiently manufactured, transported, and installed in an operating location.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

While only certain features and embodiments of the disclosure have been illustrated and described, many modifications and changes may occur to those skilled in the art, such as variations in number, proportions, sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heating, ventilation, and air conditioning (HVAC) system, comprising:

a first variable refrigerant flow (VRF) unit comprising a first variable speed compressor, a first VRF heat exchanger, and a first reversing valve of a vapor compression system;

a second VRF unit comprising a second variable speed compressor, a second VRF heat exchanger, and a second reversing valve of the vapor compression system;

an air handling unit (AHU) comprising an AHU heat exchanger of the vapor compression system; and a housing, wherein the first VRF unit, the second VRF unit, and the AHU are disposed within the housing, wherein the first variable speed compressor is configured to circulate a refrigerant through the first VRF heat exchanger and the AHU heat exchanger, the second variable speed compressor is configured to circulate the refrigerant through the second VRF heat exchanger and the AHU heat exchanger, and the first reversing valve and the second reversing valve are configured to adjust a flow direction of the refrigerant through the vapor compression system to adjust operation of the HVAC system between a cooling operating mode and a heating operating mode.

2. The HVAC system of claim 1, comprising a first expansion valve configured to adjust a first flow rate of the refrigerant through the vapor compression system.

3. The HVAC system of claim 2, comprising a metering valve configured to adjust a second flow rate of the refrigerant through the AHU heat exchanger.

4. The HVAC system of claim 1, wherein the first reversing valve and the second reversing valve are configured to direct the refrigerant through the vapor compression system in a first direction in the cooling operating mode and to direct the refrigerant through the vapor compression system in a second direction, opposite the first direction, in the heating operating mode.

5. The HVAC system of claim 4, wherein the AHU is configured to direct an air flow across the AHU heat exchanger and discharge the air flow directly into a conditioned space.

6. The HVAC system of claim 5, wherein the AHU heat exchanger is configured to enable transfer of heat from the air flow to the refrigerant in the cooling operating mode, and the AHU heat exchanger is configured to enable transfer of heat to the air flow from the refrigerant in the heating operating mode.

7. The HVAC system of claim 1, wherein the housing defines a VRF section comprising the first VRF unit and the second VRF unit, the housing defines an AHU section comprising the AHU, and the housing comprises a partition extending therethrough and separating the VRF section from the AHU section.

8. The HVAC system of claim 7, wherein the vapor compression system comprises a plurality of refrigerant tubes, and a refrigerant tube of the plurality of refrigerant tubes extends through the partition.

9. The HVAC system of claim 8, wherein the housing comprises one or more support brackets configured to couple at least one refrigerant tube of the plurality of refrigerant tubes of the vapor compression system to the housing.

10. The HVAC system of claim 7, wherein the vapor compression system comprises a separation tube configured to separate a first flow of the refrigerant from the AHU into a second flow of the refrigerant directed to the first VRF unit and a third flow of the refrigerant directed to the second VRF unit.

11. The HVAC system of claim 10, wherein the separation tube is disposed within the VRF section.

12. The HVAC system of claim 1, comprising a single power connection, wherein the single power connection is configured to receive electrical power from a power source and direct electrical power to the first VRF unit, the second VRF unit, and the AHU.

13. A rooftop unit of a heating, ventilation, and air conditioning (HVAC) system, comprising:

a housing defining a variable refrigerant flow (VRF) section and an air handling unit (AHU) section, wherein the housing comprises a partition extending therethrough and separating the VRF section and the AHU section;

a vapor compression system, comprising:

a first VRF unit comprising a first variable speed compressor, a first VRF heat exchanger, and a first reversing valve disposed within the VRF section;

a second VRF unit comprising a second variable speed compressor, a second VRF heat exchanger, and a second reversing valve disposed within the VRF section; and an AHU comprising a first AHU heat exchanger and a second AHU heat exchanger disposed within the AHU section, wherein the first VRF unit, the second VRF unit, and the AHU are pre-packaged within the housing, the first reversing valve and the second reversing valve are configured to adjust a flow direction of a refrigerant through a refrigerant circuit of the vapor compression system to adjust operation of the vapor compression system between a heating mode and a cooling mode, and wherein each of the first AHU heat exchanger and the second AHU heat exchanger is configured to receive the refrigerant from the first VRF heat exchanger and the second VRF heat exchanger and place the refrigerant in a heat exchange relationship with an air flow, and the AHU section is configured to discharge the air flow into a conditioned space.

14. The rooftop unit of claim 13, wherein the vapor compression system comprises:

a first metering valve associated with the first AHU heat exchanger and configured to adjust a first flow rate of the refrigerant through the first AHU heat exchanger; and a second metering valve associated with the second AHU heat exchanger and configured to adjust a second flow rate of the refrigerant through the second AHU heat exchanger.

15. The rooftop unit of claim 13, wherein the first AHU heat exchanger is configured to place the refrigerant in a respective heat exchange relationship with a first portion of the air flow, and the second AHU heat exchanger is configured to place the refrigerant in a respective heat exchange relationship with a second portion of the air flow.

16. The rooftop unit of claim 13, wherein the first AHU heat exchanger and the second AHU heat exchanger are arranged in a row split configuration.

17. The rooftop unit of claim 13, wherein the first variable speed compressor is configured to circulate the refrigerant through the first VRF unit and direct the refrigerant towards the first AHU heat exchanger and the second AHU heat exchanger, and wherein the second variable speed compressor is configured to circulate the refrigerant through the second VRF unit and direct the refrigerant towards the first AHU heat exchanger and the second AHU heat exchanger.

18. A packaged unit of a heating, ventilation, and air conditioning (HVAC) system, comprising:

a housing defining a variable refrigerant flow (VRF) section and an air handling unit (AHU) section, wherein the housing comprises a partition separating the VRF section and the AHU section;

a vapor compression system, comprising:

a refrigerant circuit configured to operate in a cooling mode to cool an air flow and to operate in a heating mode to heat the air flow;

a plurality of VRF units disposed within the VRF section, wherein each VRF unit of the plurality of VRF units comprises a compressor, a first heat exchanger, and a reversing valve; and an AHU disposed within the AHU section, wherein the AHU comprises a second heat exchanger configured to place a refrigerant of the refrigerant circuit in a heat exchange relationship with the air flow, the second heat exchanger is configured to receive a flow of the refrigerant that comprises at least a portion of each respective flow of the refrigerant from each VRF unit of the plurality of VRF units, and the AHU is configured to discharge the air flow directly into a conditioned space.

19. The packaged unit of claim 18, wherein the VRF section and the AHU section are disposed in a side-by-side arrangement within the housing, such that a length of the VRF section, a length of the AHU section, and the partition extend in a common direction.

20. The packaged unit of claim 19, wherein the plurality of VRF units is positioned within the VRF section in a side-by-side arrangement, such that a respective length of each VRF unit of the plurality of VRF units extends crosswise to respective lengths of the VRF section, the AHU section, and the partition.

* * * * *